US010964518B2

(12) United States Patent
Gill et al.

(10) Patent No.: US 10,964,518 B2
(45) Date of Patent: Mar. 30, 2021

(54) TRANSPORT DEVICE FOR TRANSPORTING CHARGED PARTICLES

(71) Applicant: SHIMADZU CORPORATION, Kyoto (JP)

(72) Inventors: Matthew Gill, Manchester (GB); Roger Giles, Manchester (GB); Alina Giles, Manchester (GB)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/341,993

(22) PCT Filed: Dec. 11, 2017

(86) PCT No.: PCT/EP2017/082286
§ 371 (c)(1),
(2) Date: Apr. 15, 2019

(87) PCT Pub. No.: WO2018/114442
PCT Pub. Date: Jun. 28, 2018

(65) Prior Publication Data

US 2019/0252175 A1 Aug. 15, 2019

(30) Foreign Application Priority Data

Dec. 19, 2016 (GB) ..... 1621587

(51) Int. Cl.
*H01J 49/00* (2006.01)
*H01J 49/06* (2006.01)
(Continued)

(52) U.S. Cl.
CPC ..... *H01J 49/065* (2013.01); *H01J 49/062* (2013.01); *H01J 49/36* (2013.01); *H01J 49/427* (2013.01)

(58) Field of Classification Search
USPC ..... 250/292
See application file for complete search history.

(56) References Cited

U.S. PATENT DOCUMENTS 6,812,453 B2 * 11/2004 Bateman ..... H01J 49/062 250/287
6,838,662 B2 * 1/2005 Bateman ..... H01J 49/4235 250/281
(Continued)

FOREIGN PATENT DOCUMENTS

EP 1 367 633 A2 12/2003
GB 2 391 697 B 7/2004
(Continued)

OTHER PUBLICATIONS

Written Opinion of the International Searching Authority of PCT/EP2017/082286 dated Feb. 21, 2018.
(Continued)

*Primary Examiner* — Phillip A Johnston
(74) *Attorney, Agent, or Firm* — Sughrue Mion, PLLC

(57) ABSTRACT

An apparatus for transporting charged particles. The apparatus includes a control unit and a transport device having a plurality of electrodes arranged around a transport channel, wherein the transport channel includes a bunch forming region configured to receive charged particles received by the transport device. The control unit is configured to control voltages applied to the electrodes to generate a transport potential in the transport channel, the transport potential having a plurality of potential wells which are configured to move so as to transport charged particles along the transport channel in one or more bunches. The control unit is further configured to control voltages applied to the electrodes: temporarily generate a gathering potential in the bunch forming region so that charged particles received by the transport device are gathered in the bunch forming region;
(Continued)

and then generate the transport potential in the bunch forming region so that a selected potential well is formed in the bunch forming region with the selected potential well receiving a bunch of charged particles formed from the charged particles gathered in the bunch forming region by the gathering potential.

18 Claims, 8 Drawing Sheets

(51) Int. Cl.
*H01J 49/36* (2006.01)
*H01J 49/42* (2006.01)

(56) References Cited

U.S. PATENT DOCUMENTS 8,212,208 B2 * 7/2012 Green ..... H01J 49/4225 250/283
8,822,918 B2 * 9/2014 Taniguchi ..... H01J 49/063 250/283
8,981,287 B2 3/2015 Giles et al.
2009/0278043 A1 11/2009 Satake et al.
2014/0061457 A1 3/2014 Berdnikov et al.
2014/0070087 A1 3/2014 Giles et al.

FOREIGN PATENT DOCUMENTS

GB 2 515 617 A 12/2014
WO 2007/060755 A1 5/2007
WO 2012/150351 A1 11/2012
WO 2014/140579 A1 9/2014

OTHER PUBLICATIONS

International Search Report of PCT/EP2017/082286 dated Feb. 21, 2018.

* cited by examiner

TRANSPORT DEVICE FOR TRANSPORTING CHARGED PARTICLES

CROSS REFERENCE TO RELATED APPLICATIONS

This application is a National Stage of International Application No. PCT/EP2017/082286 filed Dec. 11, 2017, claiming priority based on British Patent Application No. 1621587.3 filed Dec. 19, 2016.

TECHNICAL FIELD OF THE INVENTION

This invention relates to a transport device for transporting charged particles.

BACKGROUND

Many sources of charged particles, such as electrospray ion sources, produce a continuous stream of charged particles (continuous in time), rather than discrete bunches of charged particles. However, for many analysis devices configured to analyse charged particles, it is preferable for charged particles to be analysed in bunches, rather than as a continuous stream. An example of such an analysis device is a time of flight ("ToF") analyser.

Transport devices configured to transport charged particles along a transport channel in one or more bunches have therefore been developed.

An example of such a transport device is described in WO2012/150351 and US2014/0061457 A1. This transport device, which hereafter may be referred to as the "A-device", uses a non-uniform high-frequency electric field, the pseudopotential of which has a plurality of potential wells, each suitable for transporting a respective bunch of charged particles. A transport device that generates a potential having similar qualities, albeit by analogue rather than digital means, is also disclosed in US2009/278043 A1.

Another example of such a transport device is described in GB2391697B. This transport device, which may hereafter be referred to as a "T-Wave" device, ion guide or collision cell, produces a DC electric field that includes a plurality of potential wells, each suitable for transporting a respective bunch of charged particles. In the "T-Wave" device, RF waveforms are applied in antiphase to alternate ring-electrodes in a stacked ring system so as to generate a radial confinement field. A travelling DC potential is applied sequentially to electrodes to generate a DC barrier which urges the radially trapped ions along the device. Multiple DC barriers may be formed in order to separate the trapped ions into bunches.

Thus, in both the A-device and T-Wave device, a plurality of electrodes are controlled to generate a transport potential in a transport channel, the transport potential having a plurality of potential wells configured to transport charged particles along the transport channel in one or more bunches.

The present inventors have observed that during injection of charged particles into a charged particle transport device which incorporates travelling wells, it is desirable to be able to inject a wide mass range of charged particles and to selectively choose which wells charged particles are injected into. The desirability of a wide mass range is clear as this will improve the performance of an analytical method like mass spectrometry.

As described in more detail below, the present inventors have found that, in the case where charged particles with a wide range of masses enter an A-device as described in WO2012/150351, those charged particles with a lower mass have a tendency to be received by different potential wells compared with charged particles with a higher mass. As a result, the mass range of each bunch of charged particles contained by a respective potential well is limited or may not accurately represent the number of charged particles of each mass that were present in the initial collection of charged particles.

The present inventors have also noticed that, in the case where bunches are to be extracted from the transport device, for example by an extraction potential configured to extract a bunch of charged particles contained by a target potential well out of the transport device can cause bunches other than the target bunch to be distorted. This can lead to a total loss of ions, partial loss of ions, or an increased energy of ions, resulting lower duty cycle and lower sensitivity.

Such distorting effects can be seen in FIGS. 6 and 7, which have been obtained by simulation of a device described in detail below. These effects can reduce the accuracy and duty cycle of downstream analysis devices, such as ToF analysis devices (for which bunches of charged particles are often used). The present invention has been devised in light of the above considerations.

SUMMARY OF THE INVENTION

A first aspect of the present invention may provide:

an apparatus for transporting charged particles, the apparatus including:

a control unit; and a transport device having a plurality of electrodes arranged around a transport channel, wherein the transport channel includes a bunch forming region configured to receive charged particles received by the transport device;

wherein the control unit is configured to control voltages applied to the electrodes to generate a transport potential in the transport channel, the transport potential having a plurality of potential wells which are configured to move so as to transport charged particles along the transport channel in one or more bunches;

wherein the control unit is configured to control the voltages applied to the electrodes to:

temporarily generate a gathering potential in the bunch forming region so that charged particles received by the transport device are gathered in the bunch forming region; and then generate the transport potential in the bunch forming region so that a selected potential well is formed in the bunch forming region with the selected potential well receiving a bunch of charged particles formed from the charged particles gathered in the bunch forming region by the gathering potential.

In this way, the selected potential well can be provided with a bunch of charged particles in a manner that helps to reduce spillage and/or scattering of the charged particles compared e.g. with a method in which a bunch of charged particles is injected directly into a channel in which a transport potential is continuously generated.

Preferably, the bunch of charged particles that is contained by the selected potential well includes a majority of, more preferably substantially all of, the charged particles gathered in the bunch forming region by the gathering potential. This is preferred since charged particles that are not contained by the selected potential well (e.g. because they instead are contained by neighbouring wells) might not be useable for subsequent analysis and may therefore be deemed wasted.

However, whilst it might typically be preferable for the bunch of charged particles that is contained by the selected potential well to include substantially all of the charged particles in the bunch forming region, this may be difficult to achieve in practice, e.g. due to scattering caused by generating the transport potential in the bunch forming region or due to charged particles being continually injected into the bunch forming region.

Preferably, the gathering potential includes a potential well for gathering charged particles in the bunch forming region. The potential well is preferably configured to axially confine charged particles relative to a longitudinal axis that extends along the transport channel.

The potential well included in the gathering potential may be static.

The gathering potential may include, e.g. in addition to the potential well, a radial confining potential, wherein the radial confining potential is configured to confine charged particles in a radial direction (e.g. radial relative to a longitudinal axis that extends along the transport channel) in the bunch forming region. The radial confining potential may be an AC potential, e.g. an RF potential, e.g. an RF multipole field generated by applying an RF potential to electrodes of a multipole (RF=radiofrequency).

The potential well may have an upstream potential barrier and a downstream potential barrier, wherein the upstream potential barrier is closer to an inlet of the transport device than the downstream potential barrier.

The downstream potential barrier may be configured to inhibit (more preferably substantially prevent) charged particles gathered in the potential well from exiting the potential well in a direction leading away from the inlet of the transport device. The potential difference between a bottom of the potential well and a top of the downstream potential barrier may be 0.01V or more, more preferably 0.1 V or more, more preferably 1V or more, more preferably 2V or more.

The upstream potential barrier may be configured to urge charged particles towards a bottom of the potential well as well as to inhibit (more preferably substantially prevent) charged particles gathered in the potential well from exiting the potential well in a direction leading towards the inlet of the transport device. The potential difference between a bottom of the potential well and a top of the upstream potential barrier may be at least 0.01 V, and is preferably less than 0.5 V. This potential difference is preferably smaller than the potential difference between the bottom of the potential well and the top of the downstream potential barrier. Indeed, the potential difference between the bottom of the potential well and the top of the upstream potential barrier may be as small as possible so as to minimise the energy given to charged particles entering into the potential well from the inlet of the transport device, whilst being large enough to urge ions into the potential well from the inlet of the transport device as well as to confine them in the potential well. The reason this potential difference is preferably as small as possible is that it is desirable for the charged particles entering into the potential well from the inlet of the transport device to be urged into the potential well without imparting significant energy to the charged particles, thereby helping to gather charged particles having a low average kinetic energy in the potential well. Bunches of charged particles having a lower kinetic energy generally have a smaller spatial spread and require less deep potential wells to prevent over-spilling into neighbouring potential wells.

The upstream potential barrier may have the form of a gradual potential gradient, though other forms are possible.

The bunch forming region of the transport channel may include/contain a buffer gas. The presence of such a buffer gas in the bunch forming region may help to reduce/minimise the likelihood of ions over-spilling from a selected potential well into a neighbouring potential well and to maintain tightly packed bunches of ions (e.g. bunches with a small size). The buffer gas in the bunch forming region may be a neutral gas, and may e.g. be a noble gas such as Argon.

The buffer gas in the bunch forming region preferably has a pressure that is between $5\times10^{-1}$ and $5\times10^{-4}$ mbar, more preferably between $5\times10^{-2}$ and $1\times10^{-3}$ mbar.

The buffer gas in the bunch forming region is preferably configured to reduce the thermal energy of the charged particles through collisions between the charged particles and particles of the buffer gas. The buffer gas may be cooled (e.g. by a cooling device) to enhance the cooling of charged particles, but for avoidance of any doubt, a useful cooling effect may also be provided with the buffer gas being at an ambient temperature.

Preferably, the buffer gas in the bunch forming region is configured to cool the charged particles to have an average (mean) energy lower than 20 eV, more preferably lower than 1 eV, more preferably lower than 0.1 eV, to help the likelihood of ions over-spilling from a selected potential well into a neighbouring potential well.

The control unit may be configured to control the voltages applied to the electrodes so that the gathering potential is not generated at the same time as the transport potential in the bunch forming region of the transport channel.

This is because if the gathering potential were generated at the same time as the transport potential in the bunch forming region, the transport potential could interfere with the gathering of charged particles in the bunch forming region, e.g. causing scattering of the charged particles and/or other such problematic effects.

However, for the avoidance of any doubt, there could be some overlap between the gathering potential and transport potential being generated in the bunch forming region, provided the overlap is adequately short so that the transport potential does not unduly interfere with the gathering of charged particles in the bunch forming region.

Preferably, the control unit is configured to control the voltages applied to the electrodes so that the gathering potential is temporarily generated in the bunch forming region for a predetermined amount of time, before the transport potential is generated in the bunch forming region.

The predetermined amount of time is preferably adequate to allow charged particles injected into the transport device to be gathered in the bunch forming region, whilst being short enough to allow the transport device to move on to providing subsequent potential wells with charged particles without unnecessary delay. The predetermined amount of time will also depend on various parameters such as: the number of charged particles in the bunch being sought, the rate at which charged particles are injected into the transport device, (if the charged particles are received by the transport device as a steady stream of charged particles) the current of the continuous charged particle beam, and (if a buffer gas is present) the buffer gas pressure and temperature. By way of example, if the charged particles are ions provided by an electrospray ion source (see below), the predetermined period of time may for a typical set of parameters be 0.05 ms or more, more preferably 0.6 ms or more.

The control unit may be configured to control the voltages applied to the electrodes so that voltages for generating the transport potential in the bunch forming region are applied to the electrodes (e.g. to the electrodes arranged around the bunch forming region) within 100 us, more preferably within 10 us, more preferably within 1 us, of a time at which voltages for generating the gathering potential in the bunch forming region cease to be applied to the electrodes (e.g. to the electrodes arranged around the bunch forming region), e.g. so as to achieve a quick transition between temporarily generating the gathering potential and generating the transport potential in the bunch forming region.

Preferably, the voltages for generating the transport potential in the bunch forming region are applied to the electrodes after the time at which the voltages for generating the gathering potential in the bunch forming region cease to be applied to the electrodes. However, for the avoidance of any doubt, there could be some overlap between the voltages for generating the gathering potential in the bunch forming region and the voltages for generating the transport potential in the bunch forming region being applied to the electrodes, though the overlap is preferably adequately short so that the transport potential does not unduly interfere with the gathering of charged particles in the bunch forming region.

Preferably, the control unit is configured to control the voltages applied to the electrodes to generate the transport potential in a transport region of the transport channel whilst the gathering potential is being temporarily generated in the bunch forming region, preferably so that one or more bunches of charged particles are being transported along the transport channel in the transport region whilst the gathering potential is being temporarily generated in the bunch forming region.

More preferably, the control unit is configured to control the voltages applied to the electrodes to generate the transport potential in the transport region of the transport channel both whilst the gathering potential is being temporarily generated in the bunch forming region and whilst the transport potential is being generated in the bunch forming region, preferably so that one or more bunches of charged particles can be transported along the transport channel in the transport region of the transport channel regardless of the potential being generated in the bunch forming region.

In this way, one or more bunches of charged particles that are contained by one or more potential wells in the transport region can be transported along the transport channel in the transport region whilst charged particles are being gathered (to form a new bunch) in the bunch forming region. Several bunches of charged particles may therefore be transported along the channel in respective potential wells at any one time, allowing the duty cycle of the transport device to be increased.

The transport region of the transport channel may be include/contain a buffer gas. Example properties of such a buffer gas are set out in the detailed description, below.

The transport region may be further away from an inlet of the transport device than the bunch forming region.

For avoidance of any doubt, the electrodes around the transport region may be structurally very similar or even identical to the electrodes around the bunch forming region of the transport channel. So in some embodiments, these regions may only be distinguishable only by the form and/or timing of voltages applied to the electrodes around each region.

The control unit may be configured to control the voltages applied to the electrodes so that, in any region(s) of the transport channel in which the transport potential is being generated, the plurality of potential wells move together (e.g. towards an extraction region, if present) so as to transport charged particles along the transport channel in one or more bunches. In this way, a plurality of bunches of charged particles, each bunch being contained by a respective potential well, can be moved along the channel at the same time, e.g. in a conveyor belt fashion.

The control unit may be configured to control the voltages applied to the electrodes so that, in any region(s) of the transport channel in which the transport potential is being generated, the plurality of potential wells continually move together along the transport channel (e.g. towards an extraction region, if present) so as to transport charged particles along the transport channel in one or more bunches. In this case, the plurality of potential wells may be referred to as moving or travelling potential wells, since they are continually travelling in any region(s) in which the transport potential is being generated.

If the plurality of potential wells are continually moving together in any region(s) of the transport channel whilst the transport potential is being generated in the bunch forming region, then preferably the timing/phase at which the transport potential starts to be generated in the bunch forming region is chosen so that the selected potential well is formed in the bunch forming region with the selected potential well receiving a bunch of charged particles formed from the charged particles gathered in the bunch forming region by the gathering potential. It would be well within the capability of a skilled person, with knowledge of the form of the transport potential, to configure the control unit to choose such timing/phase.

Other configurations are possible. For example, the potential wells could move at different speeds to each other and in different directions to each other. Also, some potential wells could be static when others are moving.

For the avoidance of any doubt, there may be periods of time in which the transport potential is not generated in the bunch forming region (e.g. when the gathering potential is being temporarily generated in the bunch forming region—see above), and so there may not be a plurality of potential wells (continually moving or not) in the bunch forming region during such periods.

Preferably, the transport potential having a plurality of potential wells is a non-uniform high-frequency electric field, the pseudopotential of which has a plurality of continually moving potential wells, e.g. as described in WO2012/150351 (see also US2014/0061457 A1). The plurality of potential wells may therefore be pseudopotential wells.

Another transport device that generates a potential having a plurality of continually moving potential wells, albeit generated by analogue rather than digital means, is also disclosed in US2009/278043 A1.

Alternatively, the transport potential having a plurality of potential wells may be a DC (non-oscillating) potential that includes a plurality of potential wells, each suitable for transporting a respective bunch of charged particles, e.g. a "T-wave" collision cell, as discussed above.

Preferably, the control unit is configured to control the voltages applied to the electrodes to repeatedly:

temporarily generate a gathering potential in the bunch forming region so that charged particles received by the transport device are gathered in the bunch forming region; and then generate the transport potential in the bunch forming region so that a respective selected potential well is formed in the bunch forming region with the selected potential well receiving a bunch of charged particles formed from the charged particles gathered in the bunch forming region.

The distance between selected potential wells (e.g. the distance from the bottom of one selected potential well containing a bunch of charged particles to the bottom of the next selected potential well containing a bunch of charged particles) may be 10 mm or more. Control over the separation between bunches, i.e. the distance between consecutive bunches along the axis of the transport device, allows for this separation to be matched to a given output device. For example, for the output device shown in FIG. 3, the separation may be chosen to prevent an extraction potential (if present, see below) from distorting bunches of charged particles other than a bunch contained by a target potential well.

Preferably, the selected potential wells that contain a respective bunch of charged particles correspond to every nth consecutive potential well of the transport potential where n is an integer, i.e. so that every nth consecutive potential well of the transport potential contains a respective bunch of charged particles. For example, n may be 1, 2, 3, or 4, or a larger integer.

The ability to selected the nth bunch is useful because it may allow the duty cycle to be preserved when a downstream device would otherwise perturb or fail to process ion bunches contained within adjacent potential wells. Extraction electrodes, e.g. for extracting a target bunch of ions out of the transport device in an orthogonal direction to a longitudinal axis of the transport channel, may be provided as an example of such a device.

The transport device may have an inlet configured to allow charged particles to be received by the transport device, e.g. from a source of charged particles.

The transport device may have an outlet configured to allow charged particles to exit the transport device.

In some embodiments, the electrodes may include a pair of solid (preferably hyperbolic) rod electrodes extending along at least a part of the transport channel and/or a pair of segmented (preferably hyperbolic) rod electrodes extending along at least a part of the transport channel. If both pairs are present, the pair of continuous hyperbolic rods electrodes may extend along a same part of the transport channel as the pair of segmented hyperbolic rod electrodes.

The electrodes of the transport device may include a plurality of extraction electrodes. The control unit may be configured to control the extraction electrodes to generate an extraction potential configured to extract a bunch of charged particles contained by a target potential well in an extraction region of the transport channel out of the transport device through the outlet of the transport device, e.g. towards an analysis device as described below.

In this way, a bunch of charged particles can be extracted from the transport device for subsequent analysis after they have been transported along the transport channel, e.g. by an analysis device as discussed below.

The extraction potential may be configured to extract a bunch of charged particles contained by a target potential well in an extraction region of the transport channel out of the transport device through the outlet of the transport device in a direction that is non-parallel (preferably orthogonal) to a longitudinal axis that extends along the transport channel.

The transport channel may include one or more extraction regions. The/each extraction region may be located within the transport region of the transport channel. In this way, charged particles can be transported in bunches to the/each extraction region.

Preferably, the control unit is configured to control the voltages applied to the extraction electrodes to repeatedly:

generate the transport potential in the extraction region; and then temporarily generate an extraction potential configured to extract a bunch of charged particles contained by a target potential well in the extraction region of the transport channel out of the transport device through the outlet of the transport device.

The apparatus may include an extraction power supply for producing voltages to be applied to the extraction electrodes to generate the extraction potential in the extraction region that is separate from a transport power supply for producing voltages to be applied to the extraction electrodes to generate the transport potential in the extraction region.

The control unit may be configured to control the voltages applied to the extraction electrodes so that the extraction potential is temporarily generated in the extraction region when a target potential well has travelled to a predetermined location in (e.g. a centre of) the extraction region.

If the electrodes include a pair of solid (e.g. hyperbolic) rod electrodes extending along at least a part of the transport channel and a pair of segmented (e.g. hyperbolic) rod electrodes extending along at least a part of the transport channel (see above), the pair of solid rod electrodes may be divided (e.g. along a longitudinal axis the extends along the transport channel) into at least two parts wherein one of said parts is arranged around the extraction region and serves as a pair of extraction electrodes.

If the electrodes include a pair of solid (e.g. hyperbolic) rod electrodes extending along at least a part of the transport channel and a pair of segmented (e.g. hyperbolic) rod electrodes extending along at least a part of the transport channel (see above), the pair of segmented rod electrodes may include segmented electrodes arranged around the extraction region which serve as extraction electrodes.

The inlet of the transport device may be located adjacent to the bunch forming region of the transport channel, e.g. so that charged particles received by the inlet of the transport device enter into the bunch forming region of the transport channel.

The transport device may be configured to only allow charged particles to be received by the transport device during one or more predetermined receiving time windows. Preferably, the one or more predetermined receiving time windows are chosen so that charged particles received by the transport device have time to be gathered in the bunch forming region so that, when the transport potential is generated in the bunch forming region, the bunch of charged particles that is contained by the selected potential well includes a majority of, more preferably substantially all of, the charged particles present in the bunch forming region.

Having the transport device configured to only allow charged particles to be received by the transport device during one or more predetermined receiving time windows may be particularly useful if a continuous source of charged particles is used to inject charged particles into the transport device (see below), since otherwise charged particles might continuously be injected into the transport device, which could potentially result in many of the charged particles received by the transport device not being received by the selected potential well.

Preferably, the/each predetermined receiving time window is chosen to coincide with a gathering potential time window during which the gathering potential is generated in the bunch forming region, e.g. so that charged particles are not received by the transport channel while the gathering potential is not being generated in the bunch forming region.

The transport device may be configured to only allow charged particles to be received by the transport device during one or more predetermined receiving time windows by, for example, modifying the shape of the gathering potential to include a suitably large potential barrier/well next to an inlet of the transport device and/or by using a charged particle gate outside an inlet of the transport device.

The charged particles may be ions. Other charged particles (e.g. dust particles) could also be used.

A second aspect of the present invention may provide an apparatus for analysing charged particles that includes:

- a source of charged particles configured to produce charged particles;
- an apparatus as set out in the first aspect of the invention, wherein the transport device is configured to receive charged particles produced by the source of charged particles; and
- an analysis device configured to analyse a bunch of charged particles that has been transported along the transport channel of the transport device by the transport potential.

The source of charged particles may be an atmospheric pressure ionisation ("API") source.

The control unit may act as a control unit for all elements of the apparatus for analysing charged particles (i.e. not just the transport device).

Even if charged particles are generated in bunches in an atmospheric pressure region of an atmospheric pressure ionisation source, such bunches may undergo significant broadening during transit and thus appear as a continuous stream of charged particles when received by the transport device.

An API source may include, for example, a source configured to produce charged particles by atmospheric pressure chemical ionisation, electron ionisation, field ionisation, atmospheric pressure photoionisation, inductively coupled plasma ionisation.

If the source of charged particles is configured to produce a stream of charged particles to be received by the transport device, the source of charged particles may be referred to as a "continuous" source of charged particles.

By way of example, the source of charged particles may be an electrospray ion source. This is an example of an API source which produces a stream of charged particles.

The transport device as set out in the first aspect of the invention is particularly suitable for use with a continuous source of charged particles, such as an electrospray ion source, since it is able to form discrete bunches of charged particles from a continuous stream of charged particles.

However, the source of charged particles could equally be configured to produce discrete bursts of charged particles to be received by the transport device.

For example, the source of charged particles could be a MALDI ion source configured to produce discrete bursts of charged particles to be received by the transport device MALDI ion sources generally contain a charged particle source material mixed with a matrix material, and produce charged particles by irradiation of the source and matrix mixture with laser light. MALDI ion sources are often used for the analysis of larger organic molecules, such as DNA and proteins, and generally provide discrete bursts of charged particles for receiving by the transport device. At high repetition rates, the charged particle source might be considered to be 'quasi-continuous', whereby charged particles are a provided at such a rate that the flux of charged particles might be considered a continuous stream.

The source of charged particles may be configured to produce charged particles with a large mass range, e.g. $(m/z)_{max}/(m/z)_{min} \geq 10$.

The apparatus may include a charged particle guide for guiding charged particles produced by the source of charged particles to be received by the transport device.

The charged particle guide, which may be referred to as an injection device, may include/contain with a buffer gas. The buffer gas in the charged particle guide may be configured to reduce the thermal energy of the charged particles through collisions between the charged particles and particles of the buffer gas. The buffer gas may be cooled to enhance the cooling of charged particles, but for avoidance of any doubt, a cooling effect may also be possible with the buffer gas being at ambient temperature.

The buffer gas may be configured to cool the charged particles to have an average energy value in a predetermined range, which may e.g. be 1 eV or less and preferably substantially less than 1 eV, and preferably less the 0.1 V. The average energy value may be the average kinetic energy of the charged particles.

In this way, charged particles injected into the transport device can have a low energy, which may help to reduce ion losses during the ion gathering phase or overspill of charged particles from the selected potential well.

The analysis device may be configured to analyse a bunch of charged particles that has been transported along the transport channel of the transport device and subsequently extracted from the transport device, e.g. by an extraction potential as described above.

The analysis device may include one or more of (but not limited to): a sector static mass analyser, time of flight ("ToF") mass analyser a Fourier transform ion cyclotron resonance ("FT-ICR") mass analyser, a 3d ion trap, a linear ion trap, a quadrupole mass filter, an electrostatic ion trap (such as an Orbitrap).

Preferably, the analysis device is a time-of-flight ("ToF") mass analyser configured to measure the time of flight of charged particles extracted from the transport channel.

A third aspect of the present invention may provide a method of operating a transport device or apparatus as set out in either the first or second aspects of the invention.

The method may include any step corresponding to an apparatus feature described above.

The present disclosure includes any combination of the aspects and preferred features described herein, except where such a combination is clearly impermissible or expressly avoided.

BRIEF DESCRIPTION OF THE DRAWINGS

Examples of these proposals are discussed below, with reference to the accompanying drawings in which.

DETAILED DESCRIPTION

Figure 1:
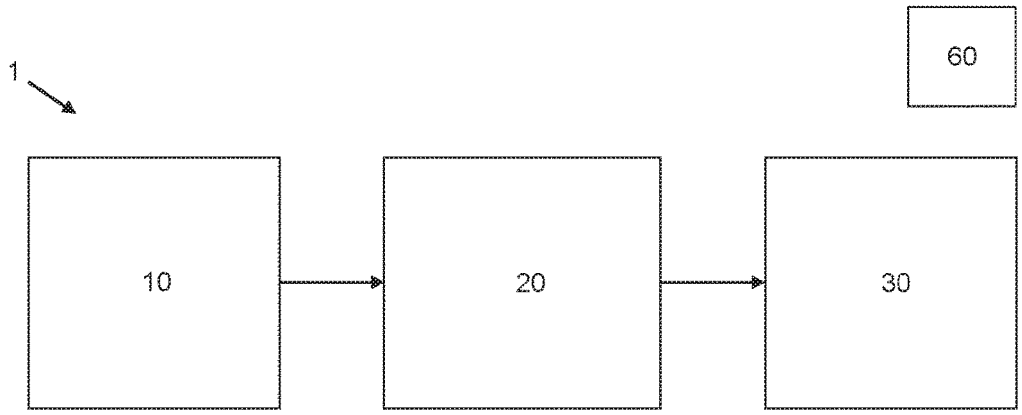
FIG. 1 shows an example apparatus for analysing charged particles.

The A-device, referred to briefly above, is a transport device which is able to transport charged particles (typically ions) in bunches in travelling pseudopotential wells with a predetermined speed. The travelling pseudopotential wells of the A-device typically move along the axis of the transport device with a predefined speed. When charged particles enter the A-device they will have a distribution of energies tightly clustered around a defined average translation energy, as they normally emerge from an injection device used to guide charged particles into the A-device, which may e.g. be a multipole ion guide and/or a cooling device (e.g. a cooling quadrupole). This average translation energy in the axial direction can be defined by the potential difference between the injection device and the A-device, to a first approximation.

Since kinetic (translation) energy can be taken as being proportional to the mass multiplied by the velocity squared, the velocities of charged particles of similar energy is determined by the masses of the charged particles. For example, for a given translation (kinetic) energy, charged particles having a mass that is four times lower than a given mass will have two times the velocity. Furthermore, if a potential difference is applied between an injection device and the A-device, the damping of the charged particles' energy would also depend on the ratio between the charged particles' masses and the mass of the surrounding gas molecules. Consequently, charged particles entering the A-device from an injection device may enter at different times and/or with different velocities, depending on their mass. In the case where it is desirable to inject a wide range of charged particle masses into the A-device, it becomes difficult to collect charged particles with a wide mass range efficiently and into a single bunch within a single potential well.

In an A-device, charged particles are preferably transported in bunches, with each bunch being confined to a respective travelling pseudopotential well. The depth of a pseudopotential well as experienced by a given charged particle is inversely proportional to the mass of the charged particle. Consequently, heavier charged particles experience a shallower pseudopotential barrier, and can be lost e.g. over the barrier into adjacent wells.

Factors that lead to mass discrimination (such as the reduced mass range of bunches) in an A-device include:

1) The dependence of a charged particle's velocity on its mass leading to a wide range of charged particles' velocities. This means it can be difficult to trap a wide range of masses efficiently and difficult to trap charged particles in a single well. Charged particles become spread over several wells, and they also may not be introduced at a favourable phase of the transport potential and so can gain a high energy, resulting in loss from the channel.
2) The inverse dependence of the height of the pseudopotential barriers as experienced by charged particles with charged particle mass. Charged particles possessing the same initial energy upon receipt by the A-device have different likelihoods of being confined to the same pseudopotential well over the same period of time.

Both of these factors can result in charged particles with a wide mass range being spread across several neighbouring pseudopotential wells in practice. The wider the mass range of the source of charged particles, the wider the spread of the charged particles along the transport device even if the charged particles enter the ion guide at the same time. The comparative data given at the end of this section illustrates this effect.

The net result can be detrimental for many reasons, these reasons including the following:

1) In some cases it can be desirable to maintain the temporal/spatial positioning of a bunch of charged particles in a single well. Charged particles spilling over into neighbouring wells would blur the temporal/spatial resolution of the charged particles. In other words, a tightly defined bunch would become spread out.
2) When wanting to inject charged particles into only a single well, the "spilling over" of charged particles into neighbouring wells can result in the loss of the charged particles which are not captured into the target well. For example, if performing analysis on only those charged particles trapped in a target well, charged particles injected unintentionally into neighbouring wells may not be analysed, which can reduce duty cycle and sensitivity. Some techniques, such as the extraction to an analyser such as a time of flight analyser, may involve the loss of charged particles in wells neighbouring the target well. And even if charged particles in wells neighbouring the target well are not lost through extraction of charged particles in the target well to an analyser, the energy/spatial properties of charged particles in the wells neighbouring the target well could be modified by application of an extraction potential to extract charged particles from the target well, which could impair the performance of the time of flight system for bunches in wells neighbouring the target well. Moreover, if each potential well of the transport potential were to contain a bunch of charged particles to be analysed, then all such bunches could be lost, e.g. through each bunch being disturbed and consequently lost before it reaches an extraction region through an extraction potential being applied to a target well located in the extraction region.

Thus, the present inventors believe it would be desirable to improve the efficiency and specificity of charged particles received by a transport device, with the net result that charged particle spread and losses during receipt by the transport device and charged particle loss during extraction by an extraction potential are minimised.

One approach considered by the present inventors for injecting charged particles to be received by selected potential wells in an A-device was to 'gate' charged particles into the device using an electric gate potential at the inlet of the transport device. In this approach, a DC barrier could be maintained at the entry of the charged particle transport device, so that charged particles can be slowed down behind this barrier. At an appropriate time (e.g. at a favourable phase of the transport potential), this DC barrier could be lowered for a predetermined amount of time, allowing charged particles to pass into the charged particle transport device. However, the present inventors found this approach used on its own to be inefficient, as the gathered charged particles entering the device would have a tendency to be spread over several wells, and the mass range of charged particles received by a single selected well would be limited and therefore too small for general analytical application).

Generally speaking, a preferred methodology devised by the present inventors for a selected potential well of a transport potential to receive a bunch of charged particles involves using a gathering potential to gather charged particles in a bunch forming region within the transport device (where they may be held, cooled and confined) and then generating a transport potential with a selected potential well being formed in the bunch forming region so that the selected potential well receives a bunch of charged particles formed from the charged particles gathered in the bunch forming region by the gathering potential, i.e. so that the selected transport potential can transport the bunch of charged particles along the transport channel in the selected potential well.

Advantages of this preferred methodology over simple "gating" of ions into the device may include the following:

- Charged particles can be placed into specific, selected potential wells in the transport device in a manner that helps to reduce/minimise mixing between bunches (this is of benefit in many applications of mass spectrometry).
- Charged particles may be introduced to a hunched transport potential with greater efficiency, e.g. with less charged particle losses.
- A wider mass range of charged particles can be more efficiently transported within a bunched transport potential compared with prior art devices.
- The separation, i.e. the distance between consecutive bunches, may be controlled using a simple form of transport channel, e.g. with only 4 waveform phases being used to create the transport potential (although invention is applicable to transport potentials having larger number of phases)

Although the preferred methodology is described herein as being implemented with an A-device, this methodology could equally be used for receipt of charged particles by other transport devices which incorporate a transport potential having a plurality of potential wells configured to transport charged particles along a transport channel in one or more bunches.

FIG. 1 shows an example apparatus 1 for analysing charged particles, which in this case are ions.

The apparatus 1 includes a source of ions 10, a transport device 20, an analysis device 30 and a control unit 60. The source of ions 10 is configured to produce ions to be received by the transport device 20. The analysis device 30 is configured to analyse ions that have been transported along (at least a portion of) a transport channel of the transport device 20.

The apparatus 1 may further include an ion guide 40 (shown in FIG. 2 but not FIG. 1) configured to guide ions produced by the source of ions 10 into the transport device 20. Alternatively, the transport device 20 may be configured to receive ions directly from the source of ions 10.

The source of ions 10 may be configured to produce a stream of ions to be received by the transport device 20. The source of ions 10 may include an electrospray ion source, for example.

The analysis device 30 may be a time-of-flight ("ToF") mass analyser configured to measure the time of flight of ions extracted from the transport channel.

Figure 2:
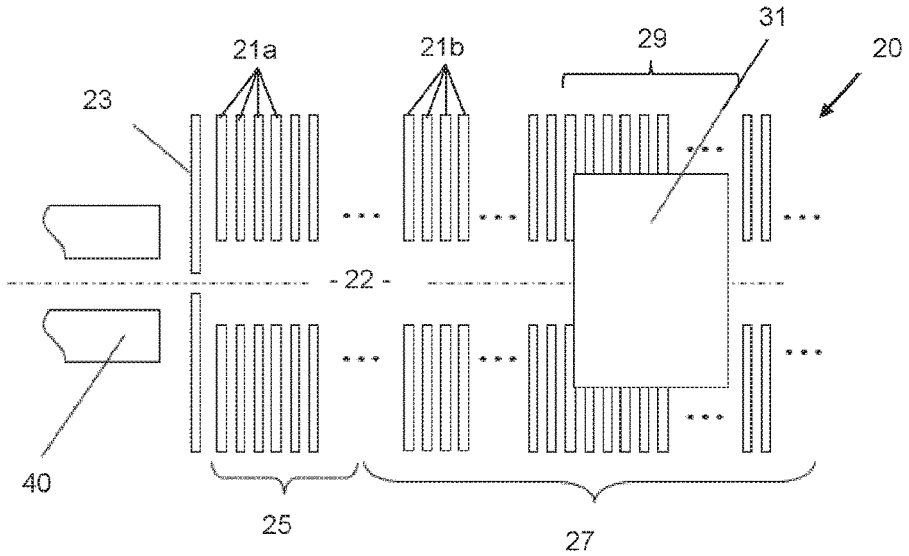
FIG. 2 shows an example transport device for use in the apparatus of FIG. 1.

FIG. 2 shows an example transport device 20 for use in the apparatus 1 of FIG. 1.

The transport device 20 has plurality of electrodes 21*a*, 21*b* arranged around a transport channel 22 (only some of the electrodes are labelled in FIG. 2). The transport channel 22 includes a bunch forming region 25 configured to receive ions received by the transport device 20 and a transport region 27 (described below). The electrodes 21*a*, 21*b* include electrodes 21*a* that are arranged around the bunch forming region 25 of the transport channel 22, and electrodes 21*b* that are arranged around the transport region 27 of the transport channel 22.

The electrodes 21*a* around the bunch forming region 25 of the transport channel 22 preferably include two or more, more preferably three or more, segmented electrodes for the generation of a suitable DC profile for the gathering potential (described in more detail below).

The bunch forming region 25 of the transport channel 22 preferably includes/contains a buffer gas. The presence of such a buffer gas in the bunch forming region 25 may help to reduce/minimise the likelihood of ions over-spilling from a selected potential well into a neighbouring potential well and to maintain tightly packed bunches of ions (e.g. bunches with a small size).

The buffer gas may be a neutral gas, e.g. a noble gas such as Argon. Preferred properties of the buffer gas in the bunch forming region 25 have already been discussed, above.

Other regions of the apparatus 1 may also include/contain a buffer gas.

For example, the ion guide 40 may be include/contain a buffer gas. The pressure of the neutral gas at the source of ions 10 could vary from less than $1\times10^{-4}$ mbar to greater than 0.1 mbar. The pressure of the buffer gas at the source of ions 10 may be set according to a desired collision rate between ions and the neutral gas in order to keep the ions energies low, prior to the ions being received by the transport device 20.

As another example, the ion guide 40 configured to guide ions produced by the source of ions 10 to be received by the transport device 20 (described below) may include/contain a buffer gas to cool the ions before they enter the bunch forming region 25. The buffer gas in the bunch forming region 25 preferably has a pressure that is between $5\times10^{-2}$ and $5\times10^{-4}$ mbar, more preferably between $1\times10^{-2}$ and $1\times10^{-3}$ mbar.

As another example, the transport region 27 of the transport channel 22 may include/contain the buffer gas. The buffer gas in the transport region 27 of the transport channel 22 may have a pressure gradient so that the pressure of the buffer gas reduces with distance from the bunch forming region 25. For example, the pressure of the buffer gas (if present) at the extraction region 29 (described below) could be $1\times10^{-4}$ mbar or lower or less than the pressure in the bunch forming region 25. This may be useful if the transport channel 22 is to be used to transport ions to a region of lower pressure, e.g. as may be useful if the ions are to be transferred to an external mass analyser requiring high vacuum.

As a skilled person would appreciate, the buffer gas in the transport region 27 of the transport channel 22 need not have a pressure gradient, and may even have a pressure gradient that increases with distance from the bunch forming region 25, or may alternatively increase and then decease The pressure of buffer gas at the extraction region 29 may be set to any level dictated by the analysis device 30 to be used in combination with the transport device 20.

The control unit 60 is preferably configured to control the electrodes 21*a*, 21*b* to generate a transport potential in the transport channel 22, the transport potential having a plurality of potential wells configured to transport ions along the transport channel 22 in one or more bunches.

The control unit 60 might e.g. include a computer, a computer program, an integrated control circuit and waveform generating circuits. The computer and computer program may be configured to interface with the integrated control circuit which might provide drive signals to control the waveform generating circuits so as to apply voltage waveforms to the electrodes 21 to generate the gathering and transport (and any other desired potentials) in the transport channel 22.

The control unit 60 is preferably configured to generate the voltage waveforms using a digital method that involves a computer, microprocessor or programmable impulse device, e.g. as described in WO2012/150351. The voltage waveforms may themselves have a digital form (e.g. comprising a finite number of discrete voltage values), e.g. as described in WO2012/150351. Analogue voltage waveforms may also be possible.

The control unit 60 of the transport device 20 is preferably configured to control the voltages applied to the electrodes 21*a* arranged around the bunch forming region 25 to: temporarily generate a gathering potential in the bunch forming region 25 so that ions received by the transport device 20 are gathered in the bunch forming region; and then generate the transport potential in the bunch forming region 25 so that the selected potential well is formed/created in the bunch forming region with the selected potential well receiving a bunch of ions formed from the ions gathered in the bunch forming region 25 by the gathering potential.

FIG. 2, in addition to showing the transport device 20, also shows the exit part of an ion guide 40 configured to guide ions produced by the source of ions 10 into the transport device 20.

The ion guide 40 may for example be a cooling quadrupole (explained in more detail below). The ions may be guided into an inlet of the transport device 20 via a small potential drop between the exit part of the ion guide 40 and the bunch forming region 25 of the transport device 20.

In this example, the inlet of the transport device 20 is provided by a diaphragm (or gas conductance restriction) 23. However, the inlet of the transport device 20 need not always be provided by a diaphragm 23, since the diaphragm 23 may be located elsewhere in the transport device 20 or omitted altogether. The diaphragm 23 may consist of a small aperture through which ions can pass, and may be configured to restrict the flow of gas from passing from the ion guide 40 to the transport channel 22, e.g. which may be useful if a cooling gas is used to cool the ions before being received by the transport channel 22 (see below).

The plurality of electrodes 21*a*, 21*b* arranged around the transport channel 22 may form a segmented hyperbolic quadrupole electrode arrangement and can be considered as being split into two regions. The first of these regions is the bunch forming region 25. After the bunch forming region 25 there is the transport region 27.

For the example transport device 20 of FIG. 2, the electrodes of the bunch forming region 25 have generally the same geometry as the electrodes of the transport region 27.

Also shown in FIG. 2 is an extraction region 29, which is located within the transport region 27 of the transport channel 22.

Figure 3:
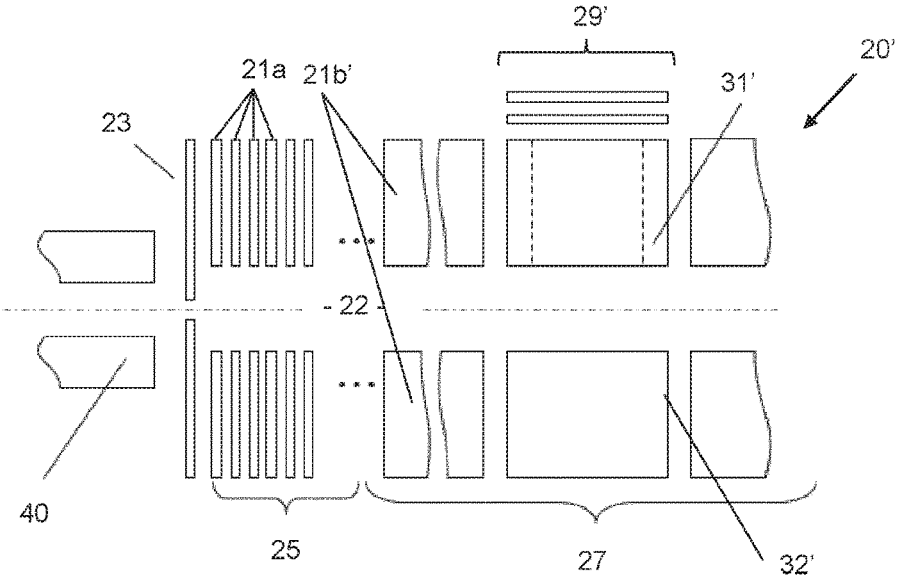
FIG. 3 shows another example transport device for use in the apparatus of FIG. 1.

FIG. 3 shows another example transport device 20' for use in the apparatus 1 of FIG. 1. Corresponding features have been given corresponding reference numerals and are the same as those described in FIG. 2 unless otherwise described below.

Unlike the transport device 20 of FIG. 2, in the transport device 20' of FIG. 3, the electrodes 21*b*' arranged around the transport region 27 include hyperbolic rod electrodes having one pair of solid rod electrodes (i.e. not segmented) in the direction of the longitudinal axis of the transport channel 22 as shown in FIG. 3 and another pair that are segmented as shown in FIG. 2. In this embodiment a DC voltage may be applied to the solid electrodes and the transport potential may be applied to the pair of rods that are segmented.

In this embodiment, part of the solid rod electrodes preferably function as extraction electrodes suitable for extraction of ions from the transport channel 22, and are configured to extract ions in a direction perpendicular to the longitudinal axis of the transport channel 22. Dashed lines show an aperture in the solid rod extraction electrodes, which provides an outlet of the transport device 20, 20' through which ions can exit the transport channel 22. This embodiment may be considered as an orthogonal extraction transport device, owing to the fact that the ions are extracted in a direction orthogonal to the longitudinal axis of the transport channel 22.

Like the transport device 20 of FIG. 2, in the transport device 20' of FIG. 3, the bunch forming region 25 of the transport channel 22 preferably has two or more, more preferably three or more, segmented electrodes for the generation of a suitable DC profile for the gathering potential.

In the transport devices 20, 20' of FIGS. 2 and 3, the form of the electrodes 21*a* arranged around the bunch forming region 25 of the transport channel 22 may be similar to the form of the electrodes 21*b* arranged around the transport region 27 of the transport channel 22. Alternatively, the electrodes 21*a* arranged around the bunch forming region 25 may have a variable profile, e.g. a funnel-like, tapering in order to match the radius of the diaphragm 23. The electrodes 21*a* arranged around the bunch forming region 25 may e.g. be apertures or rings of various shapes, or they could form quadrupoles, or other types of multipoles with electrodes of different shapes (hyperbolic, planar, circular, triangular, etc.). The profile of the electrodes 21*a* arranged around the bunch forming region 25 could e.g. be straight or curvilinear. Just as for the electrodes 21*b* arranged around the transport region 27 of FIG. 3, the electrodes 21*a* arranged around the bunch forming region 25 could include solid rods of various profiles.

The transport device 20, 20' preferably includes extraction electrodes 31, 31', 32' at the extraction region 29, 29' of the transport device 20, 20', wherein the control unit is configured to control the extraction electrodes 31, 31', 32' to temporarily generate an extraction potential configured to extract a bunch of ions contained by target potential well in the extraction region 29, 29' out of the transport device 20, 20' through an outlet of the transport device 20, 20' (not shown).

The magnitude of the extraction potential would in general depend on the details of the downstream analysis device 30, which may e.g. be a ToF mass analyser. In some embodiments, the extraction potential may be 1 kV or more. Preferably, the extraction potential is generated at a time when a bunch of ions contained by a target potential well reaches the extraction region 29, 29' of the transport device 20, 20'.

The analysis device 30 may be located along the longitudinal axis of the transport channel 22, or off-axis from the longitudinal axis of the transport channel 22, depending on the direction in which the ions are extracted from the transport channel 22. So, for the transport device 20 of FIG. 2, the analysis device 30 may be positioned to receive ions which have been extracted from the extraction region 29 in a direction parallel to the longitudinal axis of the transport channel 22. For the transport device 20' of FIG. 3, the analysis device 3 may be positioned to receive ions which have been extracted from the extraction region 29' in a direction orthogonal to the longitudinal axis of the transport channel 22.

With reference to an instrument according to FIGS. 1 and 3, in use selected wells of the transport potential may be provided with ion hunches according to the methods taught above and transported at constant velocity along the transport region 27. The transport region 27 may include a pair of hyperbolic rod electrodes that are solid rod electrodes 21*b'* (i.e. not segmented) in the direction of the longitudinal axis of the transport channel 22 (as shown in FIG. 3), and a pair of segmented hyperbolic rod electrodes (not shown in FIG. 3, but similar to the electrodes 21*b* as shown in FIG. 2). The pair of solid rod electrodes 21*b'* may be divided to define an extraction region 29' (as shown in FIG. 3) having extraction electrodes 31' and 32'. The segmented electrodes (not shown) that are located inside the extraction region 29' may have a separate supply for supplying the transport potential so that the transport potential within extraction region 29' can be terminated whilst the transport potential applied to the remaining part of transport region 27 remains.

The transport potential within extraction region 29' is preferably terminated at a specific predetermined phase of the applied RF voltage and modulation waveforms.

Upon termination of the transport potential within extraction region 29' the extraction voltages are applied to extraction electrodes 31', 32. For example, a positive extraction voltage may be applied to extraction electrode 32' with a negative extraction voltage applied to extraction voltage 31'.

Preferably the extraction voltage is applied to the extraction electrodes 31', 32' when the selected ion hunch passed through the centre of extraction region 29.

Preferably the separation between ion bunches in transport region 27 is greater than the length that the extraction region 29 extends along the transport region 27.

Upon application the extraction voltage ions pass out the channel 22 of the A-device in a direction orthogonal to the axis of channel 22 and fly towards an analyser 30.

The phase and timing of the transport potential of transport region, the transport potential of the extraction region and the extraction voltage are all controlled using the controller 60.

In some embodiments in which ions are not extracted from the transport device 20, 20', the analysis device 30 may be located within the transport channel 22 itself.

Figure 4:
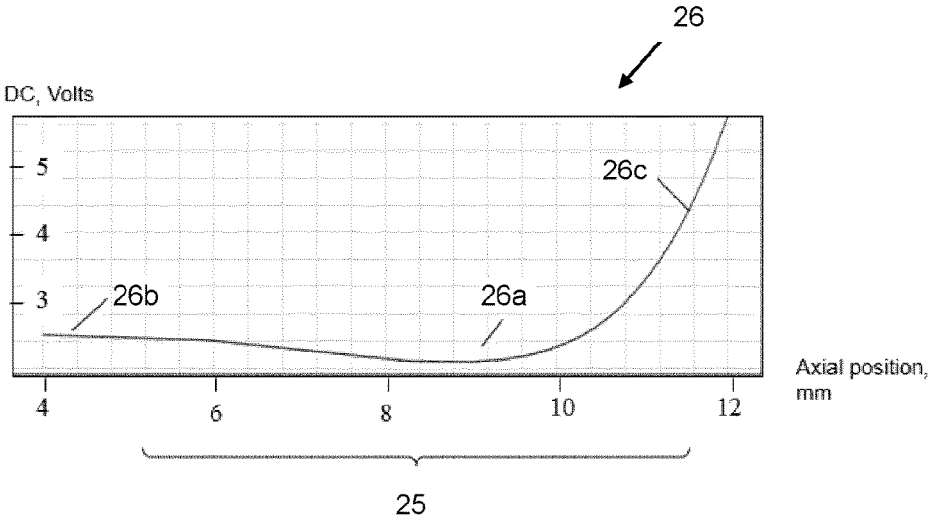
FIG. 4 shows an exemplary gathering potential to be generated in a bunch forming region, as might be used in a transport device as shown in FIG. 2 or 3.

FIG. 4 shows an exemplary gathering electrostatic potential 26 generated in a bunch forming region 25, as might be used in a transport device 20, 20' as shown in FIG. 2 or 3.

As shown by FIG. 4, the electrostatic potential 26 is a static potential well having a bottom 26*a*.

As shown in FIG. 4, the gathering potential 26 preferably includes an upstream potential barrier 26*b* and a downstream potential barrier 26*c*. The upstream potential barrier 26*b* has the form of a gradual potential gradient 26*b*. This gradual potential gradient 26*b* is shown in this example as a potential drop from a fixed potential at the inlet of the transport device 20, 20' to a potential minima at the bottom 26*a* of the static potential well. The downstream potential barrier 26*c* has a height configured to inhibit (preferably substantially prevent) ions from moving past the potential barrier 26*c*.

Preferably the gathering potential 26 is generated by controlling the control unit of the transport device 20, 20' to supply voltages ranging from fractions of a volt up to several volts, and up to tens or hundreds of volts at the highest end, to the electrodes 21*a* arranged around the bunch forming region 25 of the transport channel 22. The overall range of voltages used to generate the gathering potential 26 may vary e.g. from lower than 1 mV, to greater than 100 V.

As shown in the specific example of FIG. 4, the on axis potential at the inlet of the transport device 20, 20' may be maintained at a typical voltage of 2.5V (relative to ground). The on axis potential reduces by 0.5V towards the bottom 26*a* of the potential well provided by the gathering potential 26. Preferably, the potential difference between the bottom 26*a* of the potential well provided by the gathering potential 26 and the top of the potential barrier 26*c* is at least 1 volt, and is preferably substantially higher. FIG. 4 shows only a DC component of the gathering potential 26. An additional component of the gathering potential is an RF quadrupole field to confine the ions in a radial direction.

The gradual drop of gathering potential 26 provided by the upstream potential barrier 26*b* preferably acts, with the assistance of a buffer gas, to urge ions towards the bottom 26*a* of the potential well from the ion guide 40 without imparting significant energy to the ions at any stage, and the downstream potential barrier 26*c* preferably acts to inhibit (preferably substantially prevent) ions from moving past the potential barrier 26*c*. Hence, the gathering potential 26 encourages ions received by the transport device 20, 20' to gather in the bunch forming region 25.

The buffer gas may, for example, be Helium. Argon or Nitrogen, and is preferably introduced so that a constant pressure is maintained within the bunch forming region 25. The buffer gas helps to ensure that ions that have entered into the bunch forming region 25 from the ion guide 40 (which may be a multipole) remain in the bunch forming region 25 and are substantially not reflected back upstream to re-enter ion guide 40. The buffer gas can also assist to cool ions once they are inside the bunch forming region 25. The cooling of the ions helps to reduce the space occupied by the gathered ions and in turn helps to improve the efficiency at which ions are transferred between the gathering and transport potentials.

Figure 5A:
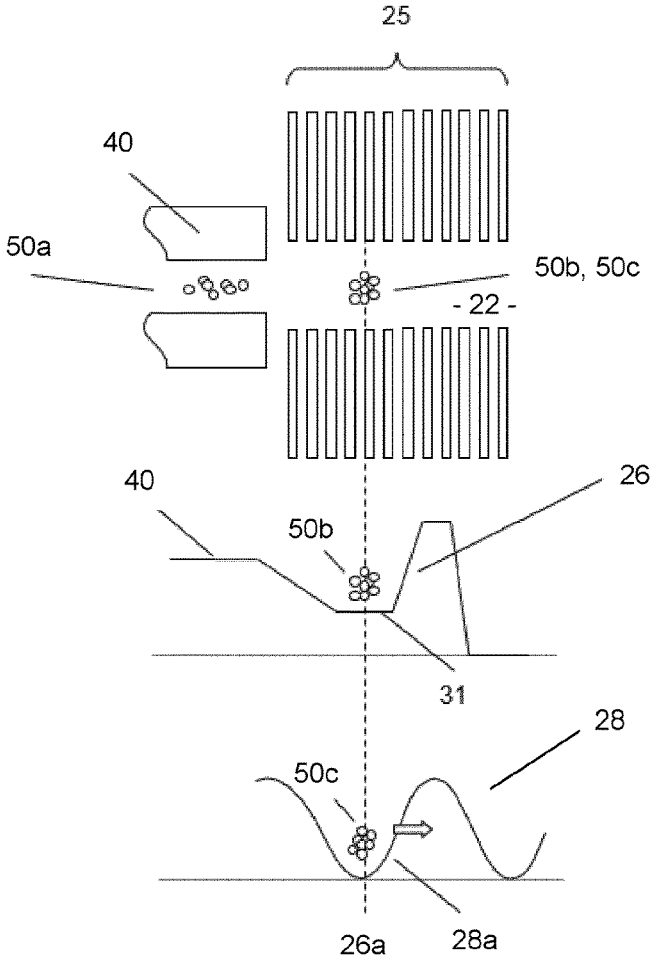
FIGS. 5(*a*) and 5(*b*) illustrate an example transition from generating the gathering potential of FIG. 4 to a transport potential in a bunch forming region, as might be used in a transport device as shown in FIG. 2 or 3.
Figure 5B:
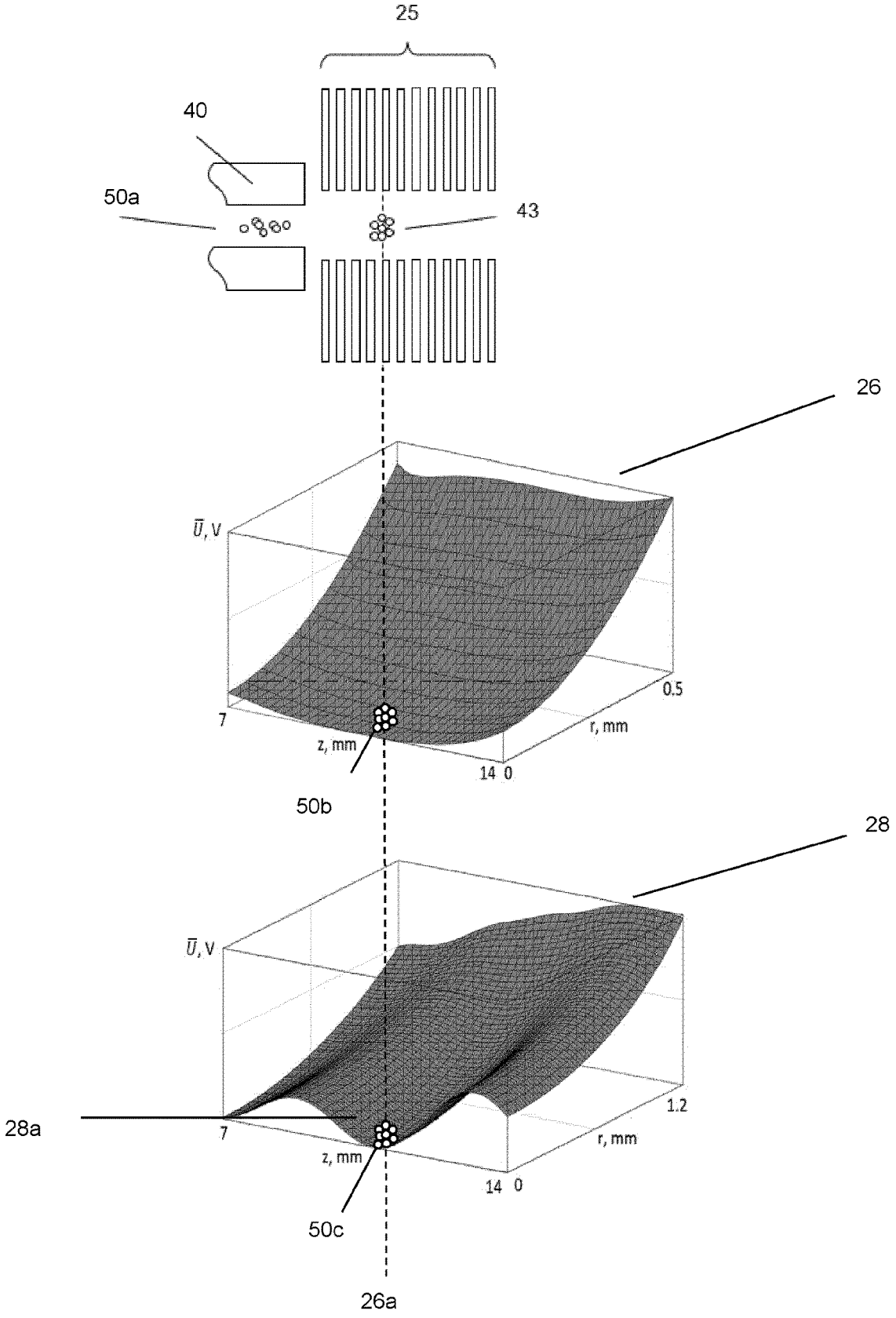

FIGS. 5(*a*) and 5(*b*) illustrate an example transition from generating the gathering potential 26 of FIG. 4 to a transport potential 28 in the bunch forming region 25, as might be used in a transport device 20, 20' as shown in FIG. 2 or 3.

FIG. 5(*b*) shows the same transition as FIG. 5(*a*), but with the gathering potential 26 and the transport potential 28 being shown in 3D, so that both axial (z-axis) and radial (r-axis) aspects of these potentials can be seen. As shown in FIGS. 5(*a*) and 5(*b*), initially ions 50*a* enter the transport channel 22 from an ion guide 40. Next, the ions 50*b* are gathered in the bunch forming region 25 by the gathering potential 26, and can (after a short cooling time) be viewed as a pre-formed bunch of ions. Next, the transport potential 28 having a plurality of travelling potential wells is generated in the bunch forming region 25, with a selected potential well 28*a* of the plurality of potential wells being formed in the bunch forming region 25 such that the minimum (bottom) of the selected potential aligns, at the time of start up with the minimum (bottom) of the gathering potential and consequently the ions 50*c*. The selected potential well 28*a* is thereby provided with a bunch of ions 50*c* formed from the ions 50*b* that were gathered in the bunch forming region 25 by the gathering potential 26. Preferably, the bunch of ions contained by the selected potential well 28*a* includes substantially all of the ions gathered in the bunch forming region 25 by the gathering potential 26, so that the bunch is formed in the selected potential well 28*a* with minimal overspill into neighbouring potential wells of the transport potential 28.

The bunch of ions 50*c* is preferably transported out of the bunch forming region 25 by the transport potential 28, before the bunch forming region 25 is returned to the gathering potential 26 to gather a next bunch of ions 50*b*.

For avoidance of any doubt, the ions 50*a*, 50*b*, 50*c* are the same ions but are labelled differently to indicate the ions at different points in time/stages of the introduction method.

Preferably, the control unit of the transport device 20, 20' is configured to control the voltages applied to the electrodes 21*a* arranged around the bunch forming region 25 so that the gathering potential 26 is temporarily generated in the bunch forming region 25 for a predetermined amount of time, before the transport potential 28 is generated in the bunch forming region 25. The predetermined amount of time is preferably adequate to allow ions received by the transport device 20, 20' to be gathered in the bunch forming region 25. This time may be a fraction of the wave period plus an integral number of the wave period of the transport potential 28. Thus, the predetermined amount of time may be a fraction of the transport potential period (the time taken for the potential wells to translate one wavelength, i.e. to move the same distance along the transport channel as the distance between two consecutive pseudopotential wells).

The transport potential 28 is preferably a non-uniform high-frequency electric field, the pseudopotential of which has a plurality of continuously travelling potential wells, e.g. as described above in connection with the A-device, though other transport potentials (e.g. as described above in connection with the T-Wave device may be used). Once the selected potential well 28*a* has been provided with the bunch of ions, the bunch can be transported, preferably with no/minimal further losses from the bunch being incurred.

The transition from the electrodes 21*a* generating the gathering potential 26 to the electrodes 21*a* generating the transport potential 28 in the hunch forming region 25 preferably includes controlling the electrodes 21*a* arranged around the bunch forming region 25 to cease the application of voltages for generating the gathering potential 26 and modifying a voltage waveform provided to the electrodes 21*a* so as to generate the transport potential 28. By ceasing the application of voltages for generating the gathering potential 26 before switching on the transport potential 28 (by applying the voltages for generating the transport potential 28), dispersion of the gathered bunch of ions can be minimised (preferably substantially eliminated). Such scattering, e.g. caused by the potential barrier 26*c* interacting with the bunch of ions 50*c* in the selected potential well could otherwise result in overspill, causing the bunch of ions 50*c* to become spread out, or even lost.

Preferably, the transition between the gathering potential 26 and the transport potential 28 is made within 100 microseconds of the gathering potential 26 being terminated, preferably within 10 and more preferably 5 microseconds. The axial position of the minima of the gathering potential 26 and the selected potential well 28*a* are preferably aligned at the time of the transition.

For avoidance of any doubt, the gathering potential 26 and transport potential 28 may each include a DC component and an AC (e.g. RF) component. The AC (e.g. RF) component of the gathering potential 26 and transport potential 28 may be used to confine the ions in a radial direction. The AC (e.g. RF) component of the gathering potential 26 may be the same as the RF component of the transport potential 28, but this need not be the case.

Preferably digital control circuitry is used to generate the gathering and transport potentials 26, 28, since this helps the transition from the gathering potential 26 to the transport potential 28 to be made quickly, efficiently, and with relative simplicity (when compared with analogue methods). For example, the transport potential 28 may be generated by the digital method as described in WO2012/150351 The digital method may refer to a method of creating an RF waveform making use of a digital signal generator and a switching arrangement, which alternately switches an electrode between high and low DC supplies (V1, V2) to generate a rectangular high voltage waveform. The digital signal generator may be controlled via a computer of other means, to control the parameters of the square waveform, such as the frequency and the duty cycle and phase. Furthermore the digital periodic waveform may be terminated at a precise phase.

In some embodiments (not illustrated), the bunch forming region 25 could be controlled by the control unit to simultaneously gather ions into several bunches within the bunch forming region 25, where the location and the size of each bunch could be predefined.

The properties/size of the/each bunch of ions is preferably suited to the transport potential 28 generated in the transport channel 22, preferably so that there is substantially no ion loss, spread of bunches across the neighbouring potential wells of the transport potential 28, and the characteristics of the ions' bunch match the wells of the transport wave (i.e. the sizes and ions' energy/depth of the well are matched).

If the transition between the gathering potential 26 and transport potential 28 in the bunch forming region 25 is performed as above, then preferably:

1) there is reduced (preferably substantially no) spread of ions across several bunches, e.g. so that the position and timing of each bunch can be predetermined; and
2) there is reduced (preferably substantially no) mass discrimination of injection, so that the mass range of the/each bunch can be as high as that determined by the transport potential 28 itself;
3) the average energy of the ion bunch does not substantially increase.

Once a selected potential well 28*a* has been provided with a bunch of ions, the transport potential 28 turns on and starts carrying the formed bunch of ions in its potential well with a predefined speed away from the position of the bottom 26*a* of the potential well provided by the gathering potential 26 and towards the transport region 27 of the transport channel, where it can then continue to be transported towards the extraction region 29, 29'.

Preferably, the transport potential 28 is continually generated in the transport region 27 of the transport device 20, 20' whilst the gathering potential 26 is being generated in the bunch forming region 25. In this way, as discussed above, any one or more bunches of ions that is contained by one or more potential wells in the transport region 27 can be transported along the transport channel 22 in the transport region 27 whilst ions are being gathered (to form a new bunch) in the bunch forming region 25. Several bunches of ions may therefore be transported down the transport channel 22 in respective potential wells at any one time, thus increasing the frequency of bunch production within the transport device 20, 20' (as well as ion throughput).

By providing selected potential well(s) in this manner, the position in time and space of bunches, and time and space gaps between bunches, formed by this method may be arbitrarily determined and matched to the requirements of an output device (if present).

The formation of bunches of ions may be time-synchronised with the guidance of ions into the transport channel 22 since, if there is minimal spread of ions across neighbouring potential wells, it is possible to ensure that there is minimal mixing between ions of different time origin. This enables the timing and position of ions in the transport channel 22 to be accurately known, or even predetermined.

In the case of a source of ions 10 which produces ions as a stream, e.g. continuous stream (e.g. in the case of an electrospray ion source), it may be advantageous to prevent ions from being received by the transport channel 22 whilst the gathering potential 26 is not being generated in the bunch forming region 25, so that the injection of ions into non-selected potential wells of the transport potential can be prevented.

In particular, an ion gate (not illustrated) at the inlet of the transport channel 22 may be used to only allow ions to be received by the transport device 20, 20' during one or more injection time windows, which are preferably synchronised with one or more gathering time windows (e.g. during which the gathering potential is generated in the bunch forming region 25). In this way, the proportion of ions present in the transport channel 22 that are contained by the selected potential well 28*a* can be maximised, that is a high duty cycle may be attained.

In order to provide radial confinement of the ions (as well as the axial refinement provided by the gathering potential), the control unit may be configured to control the voltages applied to the electrodes arranged around the transport channel 22 to generate a radial confining potential in the bunch forming region 25, in addition to the gathering potential 26, so that ions can be confined in the radial direction whilst being gathered in the bunch forming region 25. For example, a quadrupole RF field might be used for radial confinement of the ions. A radial confining potential in the hunch forming region 25 may be required where the gathering potential 26 does not itself provide radial confinement of ions, as is the case with the DC gathering potential described in FIG. 4. The control unit may be configured to control the voltages applied to the electrodes 21*a*, 21*b* arranged around the transport channel 22 to generate a radial confining potential in the transport region 27. However, this generally won't be required if the transport potential 28 is configured to provide radial confinement of ions, as is the case with the transport potentials described in connection with the "A-device" and "T-Wave" device described in the background section above.

The optional radial confining RF waveform should be chosen in accordance with the radius of the inlet of the transport channel 22, and should be chosen in order to provide a suitable bunch mass range. The range of the frequencies of the waveform(s) provided to the electrodes by the control unit may be of the order of several kilohertz to tens of megahertz, and the ground to peak amplitude of the waveform(s) provided to the electrodes by the control unit may be in the range of tens of volts up to hundreds or thousands of volts. The choice of a suitable RF waveform with suitable frequency and amplitude can be made according to standard electrodynamic theory as is well known in the art.

The voltages applied to the electrodes by the control unit for generation of the transport potential 28 may be chosen in accordance with the mass range and the desirable bunch size and bunch separation. Suitable waveforms are described in the prior art WO 2012/150351.

As mentioned above, the methods and embodiments disclosed herein may be implemented in combination with a moving pseudopotential waveform of the A-device device described in prior art WO 2012/150351. Such a combination may be considered as an improved injection method to the A-device device. It is envisaged that the transport device 20, 20' of the present disclosure could provide bunches of ions at a rate up to 5 kHz in a single channel. This would produce improved dynamic range and mass accuracy in a time of flight analyser systems incorporating the A-device, whilst retaining high sensitivity and mass range, as charge particle loss will be low over a wide mass range.

The device could also include an A-device collision cell or other fragmentation devices which retains daughter ions in bunches.

Simulation Data

The following ion transport simulations were performed in order to demonstrate the performance of embodiments of the present disclosure. Example simulations are described below which demonstrate the effectiveness of some of the embodiments. The inventors used their own in-house simulation package to simulate ion trajectories using a fourth order Runge-Kutta integration method. Electric fields were solved using a finite difference method. The collisions between the ions and the gas particles were simulated using the hard sphere model. The mean free path was defined by gas numerical density and the sizes of colliding particles.

The skilled person will recognise that the mutual repulsion between ions of like charges being transported in bunches could have some effect on the performance of the transport device. The phenomena caused by the repulsion of ions of like charge are known generally in the art as 'space-charge' effects. In the simulations in the following section, space-charge effects have not been included, and no means of modelling Coulombic repulsion of the ions has been included. The skilled reader will recognise that, in this case, space charge effects would have no effect on the general principle of operation of the device, and would have minimal effect on the outcome of the simulations or results of operation of the device provided the charge input is kept below certain critical levels. The high frequency operation of the device ensure that apparatus based upon the disclosed device and operate at practical levels of charge throughput.

Example 1: Ion Extraction Considerations

Figure 6:
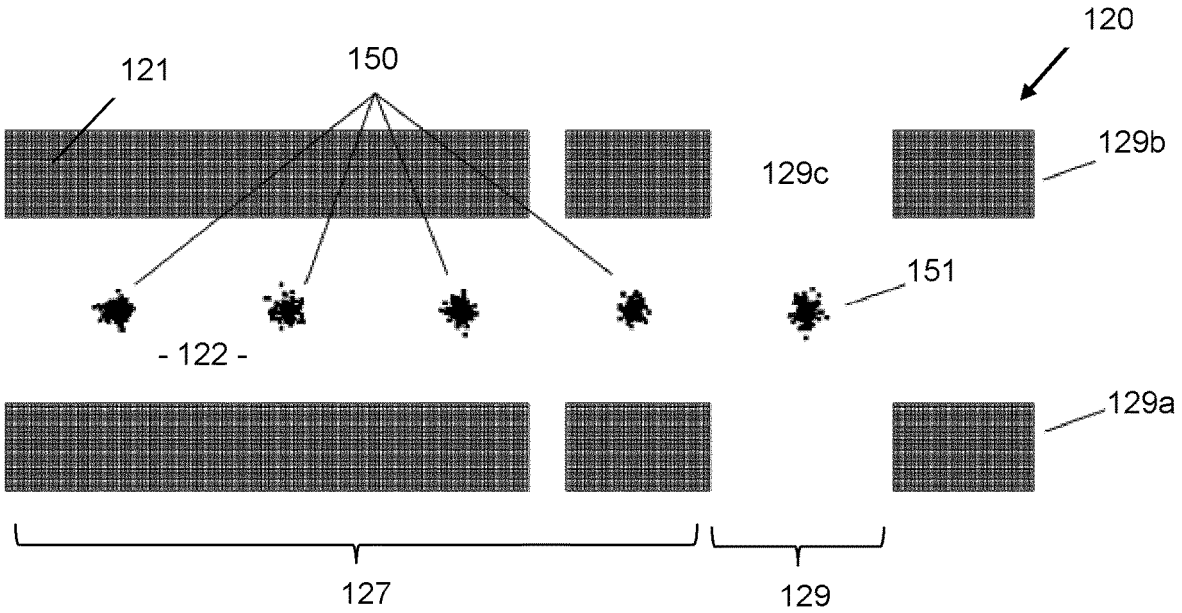
FIGS. 6 and 7 help to illustrate some advantages of the ability to allow potential wells to be selectively provided with ions in a transport potential.
Figure 7:
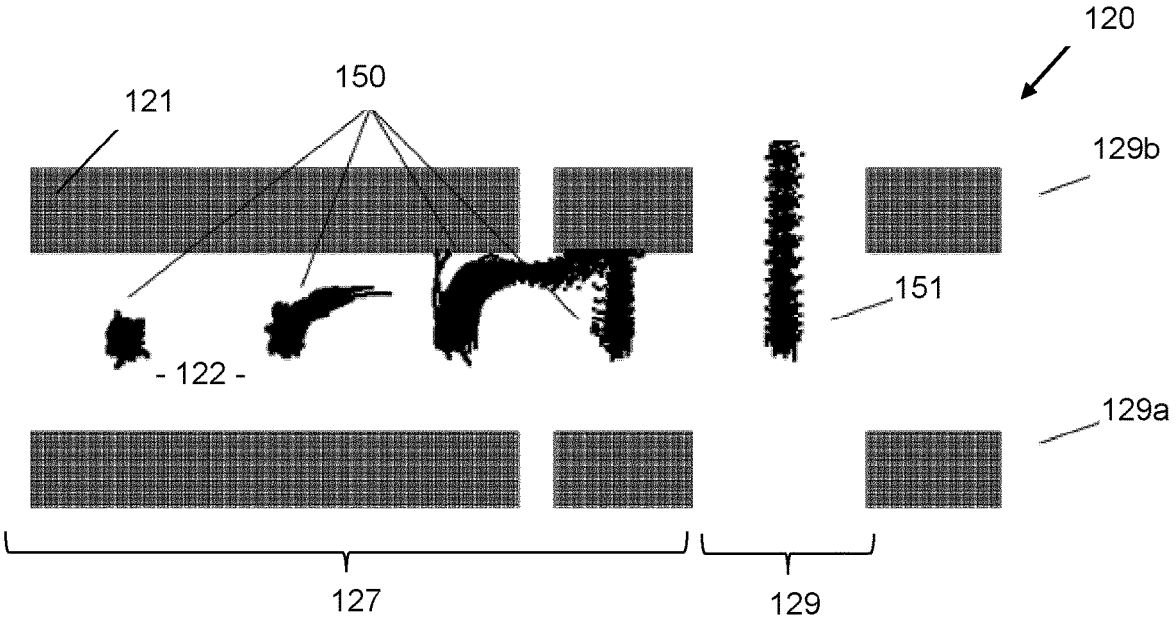

FIGS. 6 and 7 are graphical representations of simulation data that help to illustrate an advantage of the ability to allow potential wells to be selectively provided with ions in a transport potential 28.

FIGS. 6 and 7 show a cross sectional view of a transport channel 122 of a transport device 120 similar to that shown in FIG. 3 above, having an extraction region 129 from which ions can be extracted. In the transport device 120 of FIGS. 6 and 7, ions are extracted from the transport channel 122 in a direction orthogonal to the longitudinal axis of the transport device 120 by application of an extraction voltage to extraction electrodes 129*a*, 129*b* within the extraction region 129. The extraction region 129 incorporates an outlet 129*c* of the transport device 120 through which ions can exit the transport channel 122. A suitable extraction potential to orthogonally extract positive ions may be generated by applying a positive high voltage, for example 2 kV, to the extraction electrode 129*a* and applying a negative high voltage, for example −2 kV, to the extraction electrode 129*b*.

FIG. 6 shows bunches 150, 151 of ions being transported along the transport channel 122 before the application of the extraction potential. Five hunches 150, 151 can be seen along the length of the transport channel 122, one of which 151 is contained by a target potential well (not shown) just as it passes through the extraction region 129. In this case, it is desired to extract the bunch 151 in an orthogonal direction from the target well. The other bunches 150 have not yet arrived at the extraction region 129, so cannot yet be extracted.

FIG. 7 shows the situation shortly after extraction of the target bunch 151 (30 μs after the extraction potential was applied to the extraction region). The target bunch 151 can be seen to have been extracted through the outlet 129*c* of the transport device 120. It can also be seen that the other bunches 150 in proximity to the extraction region 129 have been adversely affected by the application of the extraction voltage as they have been exposed to the fringe field of the extraction field which can penetrate into the transport channel 122. In particular, the two bunches closest to the extraction region 129 can be seen to have been lost to the electrodes 121. The next closest bunch has also been significantly disturbed. The only bunch which has not been significantly disturbed is the bunch which is fourth closest to the extraction region 129. It can be seen that, in the best case, the duty cycle of successful extraction for this particular transport device 120 (e.g. extraction of non-distorted bunches) will be 1 in 4 bunches (which would correspond to an ion loss of 75% or a duty cycle of 0.25), provided the extraction voltage is applied only to every fourth bunch. This significantly reduces the sensitivity and dynamic range of the apparatus.

A possible improved approach for the transport device 120 of FIG. 7 could be to selectively provide only every fourth well with ions, e.g. based on the teaching provided above. In this way, the bunches contained by the selected potential wells can be adequately spaced to avoid distortion by the extraction voltage, thereby avoiding unnecessary loss of ions and improving the duty cycle of the apparatus.

Hence, the preferred methodology described herein can be seen as providing a way to minimise, or even substantially eliminate the adverse effects that can be caused by extraction of bunches of ions from a transport channel 122.

Figure 8:
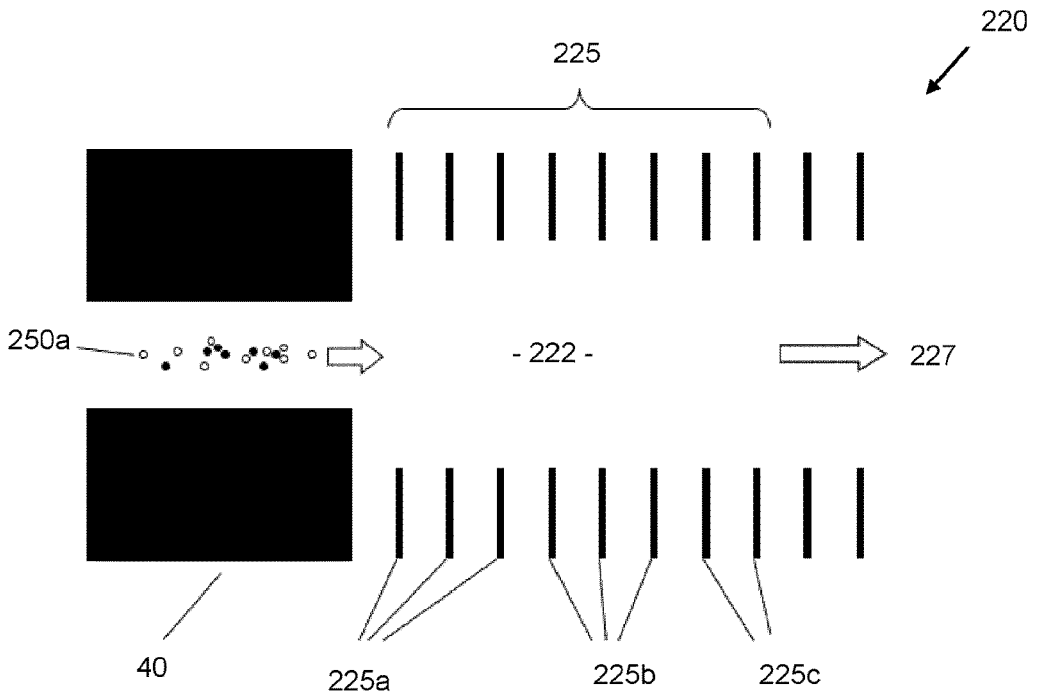
FIGS. 8-11 illustrate simulation data relating to a first example.

Example 2: Charged Particle Transport Device Consisting of Segmented Electrodes with Hyperbolic Profiles FIG. 8 shows a transport device 220 incorporating an ion guide 40 (in this case a quadrupole) and a bunch forming region 225 of a transport channel 222. Segmented hyperbolic section electrodes 225*a*, 225*b*, 225*c* are arranged around the bunch forming region 225. The transport region 227 (not shown) of the transport channel 222 has electrodes with the same geometry as those arranged around the bunch forming region 225. In this example simulation, the inner radius of the transport channel 222 (as defined by the inner radius of the electrodes arranged around the transport channel 222) is 2.5 mm. A gathering potential as described above was applied to the bunch forming region 225, thus a DC potential gradient was applied between the ion guide 40 and the bunch forming region 225. Specifically this DC potential gradient was applied by the application of 2.5V to the ion guide 40, +2V to electrodes 225*a*, 0V to electrodes 225*b*, and +8V to electrodes 225*c*, In FIG. 8, ions 250*a* at this time of the simulation are shown schematically in the ion guide 40 before being received by the transport channel 222. The simulated ions were given a range of m/z values.

An additional confining RF waveform was applied to the inlet of the transport device 220 and bunch forming region 225 whilst the DC gathering potential was being generated in the bunch forming region 225. The RF waveform had an amplitude 300 V (ground to peak) with a frequency of 3.2 MHz. The pressure of buffer gas (Argon) in this region was set to 0.01 mbar.

Figure 9:
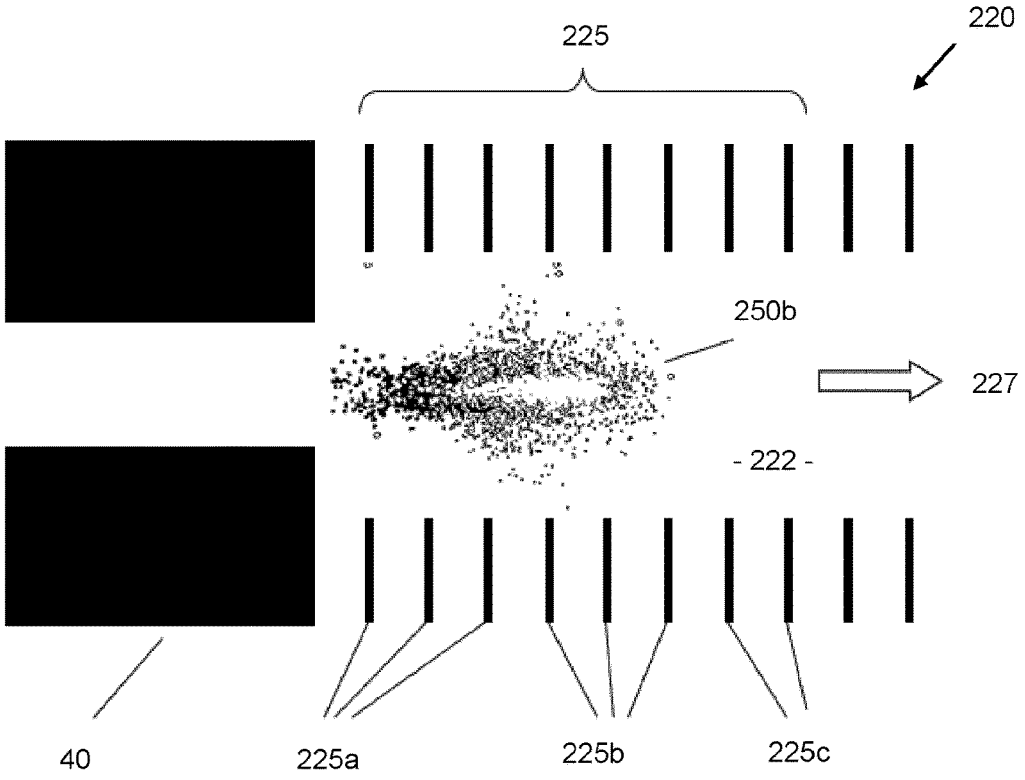

FIG. 9 shows a screenshot of ions being gathered in the bunch forming region 225 by the gathering potential. This screenshot was taken 30 μs after the screenshot of FIG. 8, e.g. 30 μs after the ions were received by the transport device 220. The majority of ions 250*b* at this time of the simulation can be seen to be within the gathering potential of the bunch forming region 225.

Figure 10:
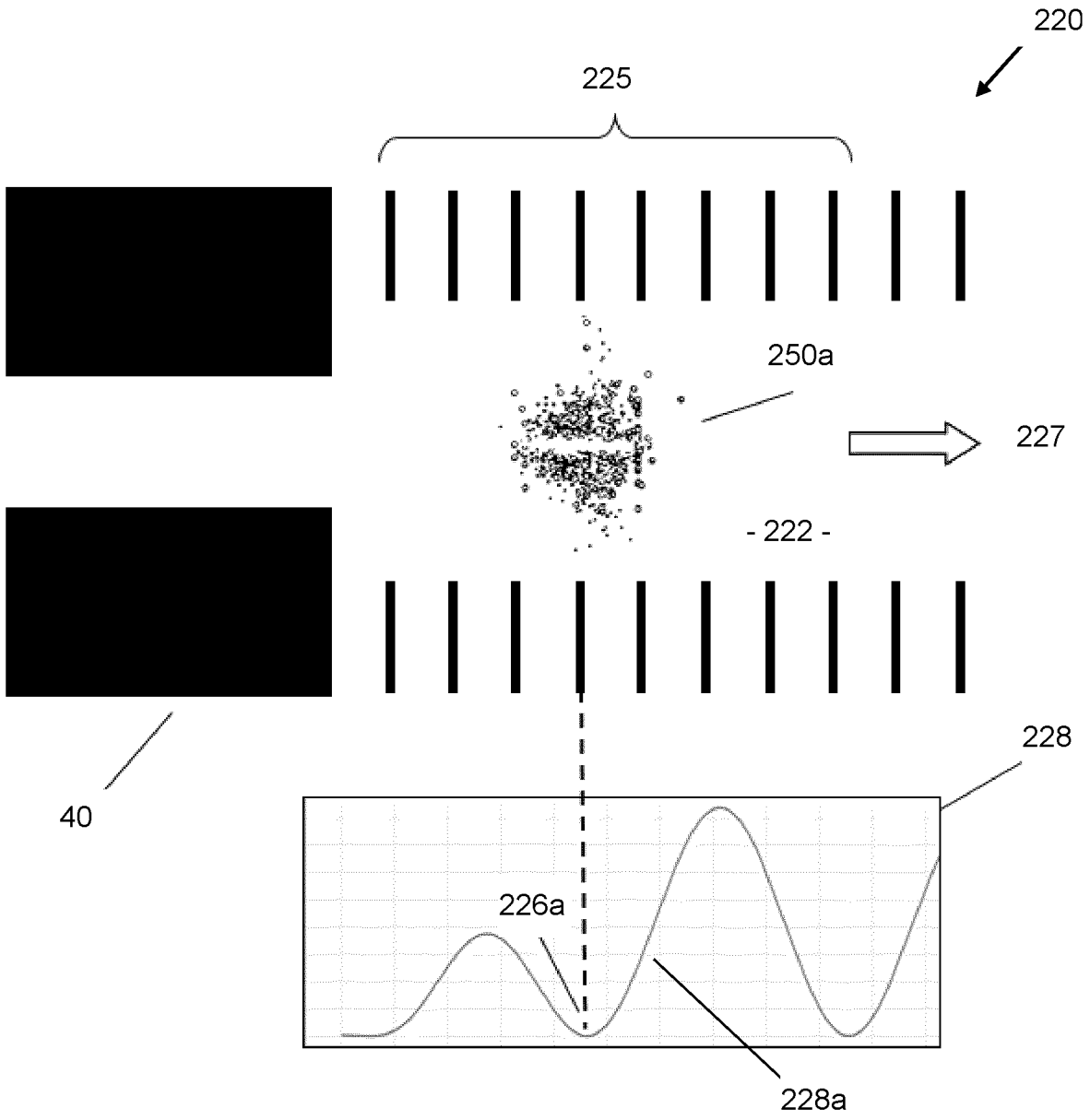
Figure 11:
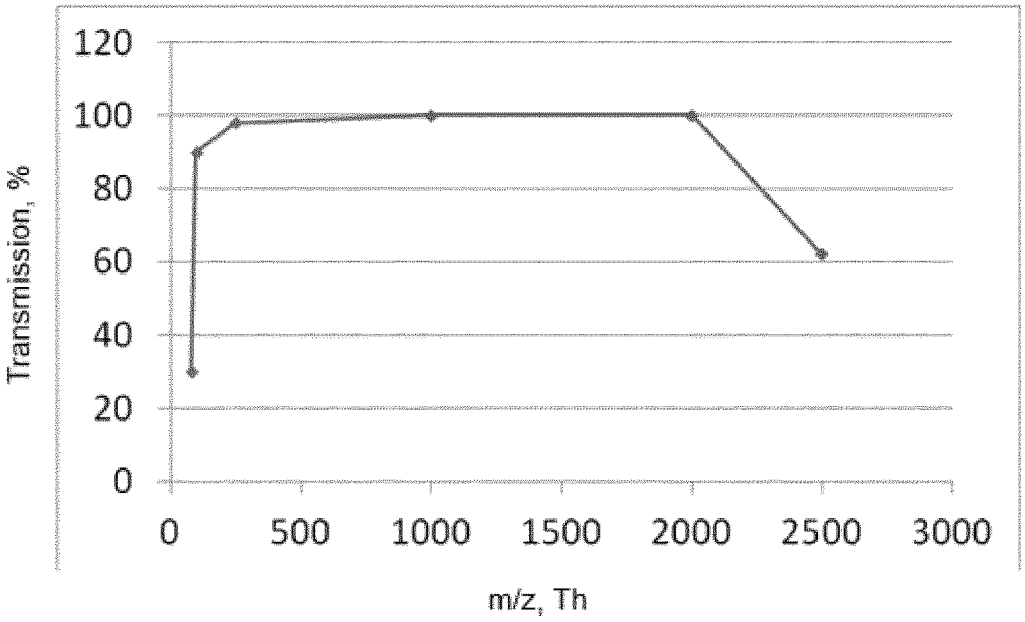

FIG. 10 shows a screenshot of an ion bunch formed from the gathered ions of FIG. 9. This screenshot was taken 220 μs after the screenshot of FIG. 9 (i.e. 250 μs after the screenshot of FIG. 8). The ion bunch is cooled and fully formed here and ready to be captured by the transport potential 228. FIG. 10 shows a bunch of ions 250*c* alongside the potential wells of an A-device transport potential 228 at the moment the transport potential 228 is turned on. In this example, the voltage waveform used to generate the A-device transport potential 228 was applied as soon as the gathering potential and the additional confining RF were switched off. The performance of the device was investigated within the range of m/z=80 Th to m/z=2500 Th. An equal amount of ions of each mass was generated at the start of the simulation at t=0. FIG. 11 shows a plot of the percentage of ions transmitted at each m/z value within a single common bunch, to the extraction region of the transport channel. Thus the invention is shown to achieve a high percentage of transmission for a wide m/z range of ions, transported within a single bunch.

Example 3: Comparison of the Formation of Bunches of Ions from Ions Injected into a Transport Channel, with and without the Bunch Forming Technique of the Present Disclosure In this example situation, the formation of bunches of ions when using a temporary gathering potential in the transport channel is compared with the formation of bunches of ions when using a charged particle gate at the inlet of a transport channel.

Figure 12:
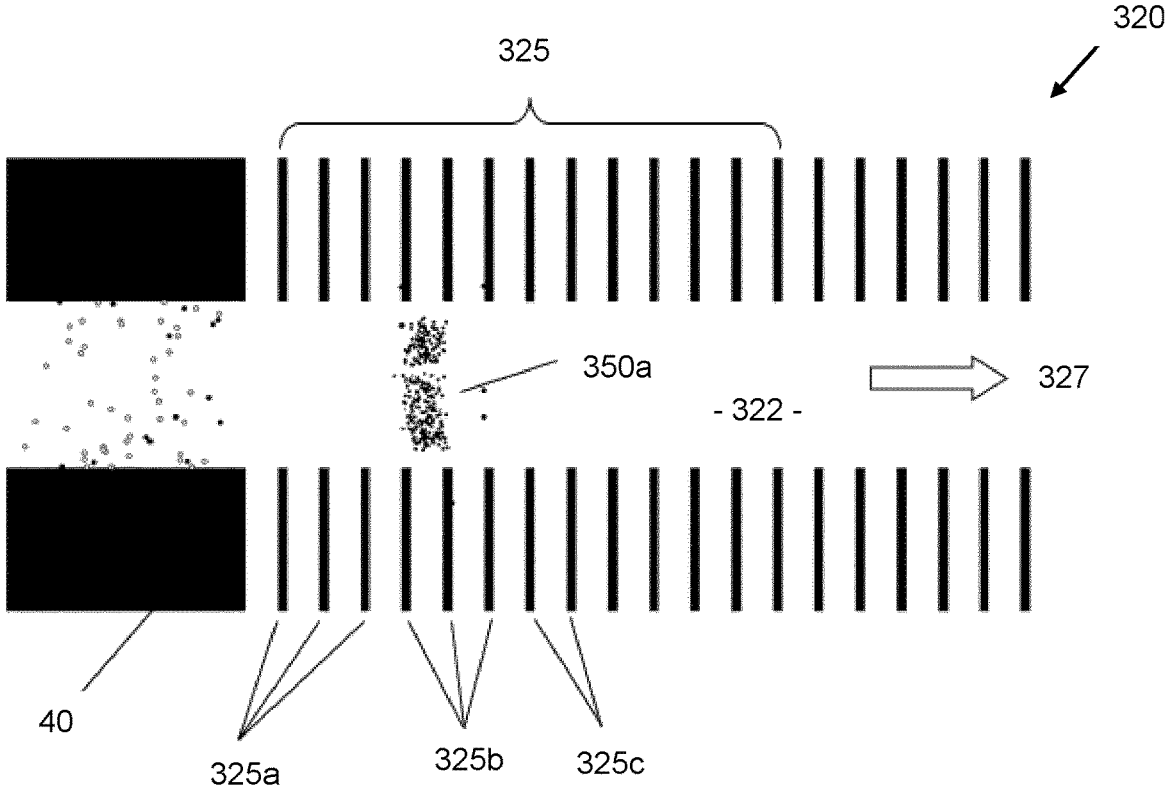
FIGS. 12-14 illustrate experimental (simulation) data relating to a second example.

The configuration chosen for this comparison is shown in FIG. 12. In this example, quadrupole electrodes are arranged around the transport channel 322, the inscribed inner radius of the transport channel 322 (as defined by the electrodes) being 2.5 mm. The bunch forming region 325 and the main body of the transport device 320 are formed from a stack of ring electrodes with circular apertures, also with an inner radius of 2.5 mm. The thickness of each ring was 0.2 mm and the separation distance between rings was 1 mm, thus the repeat distance of the electrode structure was 1.2 mm. A suitable radially confining RF waveform was applied to the ring electrodes of the bunch forming region 325 (in this example, adjacent electrodes received an antiphase RF waveform with a ground to peak amplitude of 300 V and a frequency of 3.2 MHz) while the gathering potential was being generated. A residual background gas of Argon was simulated at a pressure of 0.01 mbar for collisional cooling of the ions FIG. 12 shows ions 350*a* being gathered at a predetermined location by a gathering potential as described in example 2 (above, i.e. +2.5 V at the charged particle source 1, +2 V to electrodes labelled 325*a*, 0 V to electrodes labelled 325*b* and +8 V to electrodes labelled 325*c*). A small number of ions can be seen to have been lost to the electrodes of the bunch forming region 325 in this example.

After a suitable time (250 us) to allow ions to arrive to the bunch forming region and to allow the capturing transport potential to be in synchronisation with the rest of the transport channel, the gathering potential which was active in FIG. 12 was removed and a waveform suitable for generating a bunch transport potential having travelling potential wells (in this case an A-device transport potential) was applied. Eight suitable waveform phases were provided to the ring electrodes by the control unit. Each phase was applied to every eighth ring electrode. The details of the waveform were: f=2 MHz, V0−p=220 V (ground-to-peak voltage of the RF voltages used to generated the transport potential) and ω=4 kHz (frequency of the modulation waveform that defines the speed of the wells of A-wave and is given by ωL, where L is the repeat distance of the transport potential, or 8 ring electrodes, which is 9.6 mm in the current example. That is, the ion bunch travels at a velocity of 38.4 $ms^{-1}$).

The precise form of the waveforms to be applied may be found in prior art document WO 2012/150351.

Figure 13:
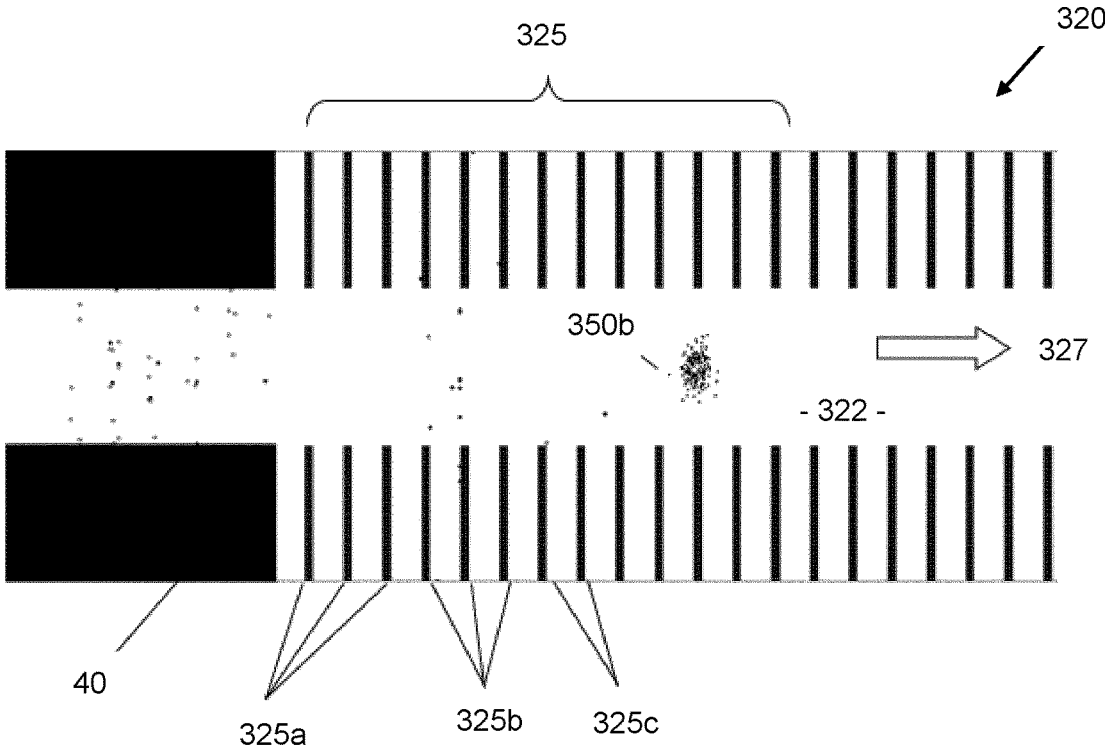

In FIG. 13 (which is a screenshot taken 250 μs after application of the transport potential), a bunch of ions 350*b* formed from the ions gathered in the bunch forming region 325 in FIG. 12 can be seen as having been moved along the length of the transport channel 322, away from the bunch forming region 325 and towards the transport region 327. The bunch of ions 350*b* can be seen to be contained within a selected potential well, with minimal overspill of ions into neighbouring potential wells, and with only a small proportion of ions lost to the electrodes.

Figure 14:
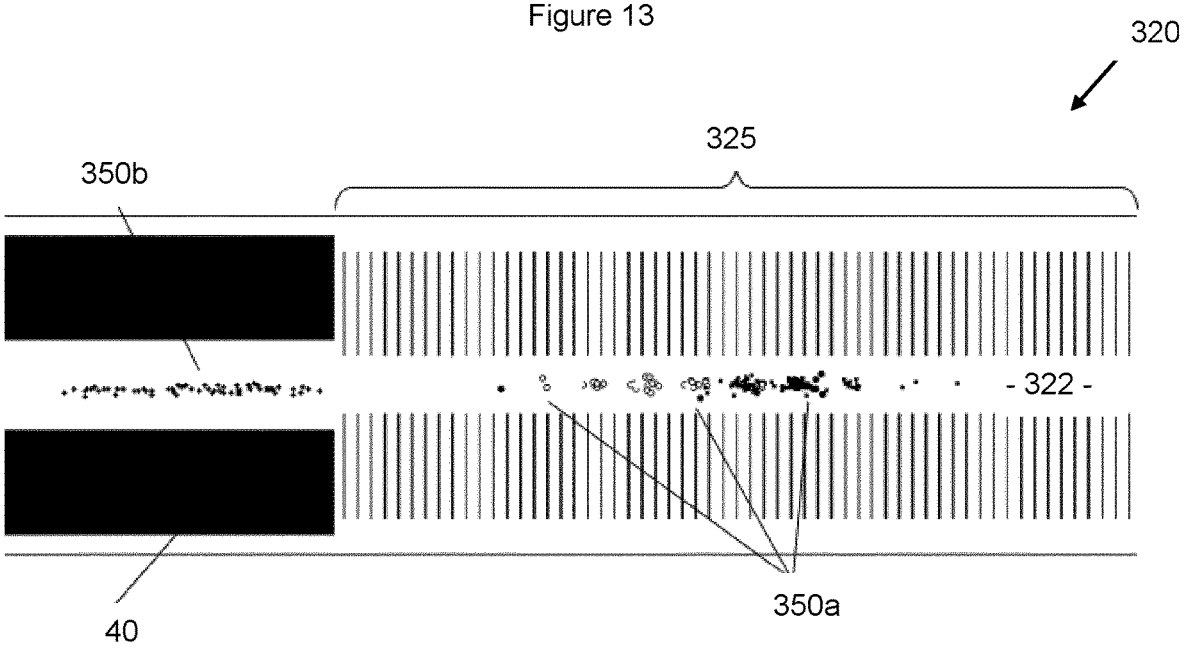

A comparative simulation of the injection of ions into the same transport channel 322 as that in FIGS. 12 and 13, but with use of an ion gate located outside of the transport device 320 and no gathering potential, is shown in FIG. 14.

In this comparative example, an ion gate was provided by having a DC barrier at the ion input end of the transport device 320, with this DC barrier being lowered to allow ions to travel down a DC potential gradient into the transport device 320.

A suitable voltage profile to achieve the ion gate operating in a 'closed' period of operation could be achieved by applying 1 V DC offset to the ion guide 40, a 5 V DC offset to the first electrode of the transport device 320 and 0 V DC offset to the remaining electrodes of the transport device 320. To 'open' the ion gate, the voltage on the first electrode of the transport device 320 could be lowered to a value between the DC offset of the source of ions 10 and the DC offset of the ion guide 40. Other voltage profiles could equally be used to provide 'gating' of an ion bunch into the transport device 320 from the ion guide 40, and the values used here are given only as an example. The general principle is that ions are held back, or slowed down in the ion guide 40 by an appropriate DC voltage barrier before being released into the transport device 320 by lowering the DC barrier such that ions can move down a DC gradient into the transport device 320. The voltages described here are suitable for positively charged ions and could be made negative to suit application for negatively charged ions.

In this case, a waveform suitable for generation of the travelling pseudopotential wells was applied to the main body of the transport device 320 continuously. An ion bunch was received by the transport device 320 with an energy of 20 eV for singly charged ions. The 20 eV initial energy of the ions was necessary to overcome the pseudo potential barrier of the transport potential in order to inject most of the ions of a wide mass range into the transport device 320.

FIG. 14 shows a snapshot from a simulation after ions have been injected into the transport device 320. Ions 350*a* can be seen to be spread over a large axial length, and can be seen to be maintained in several bunches contained by a number of different potential wells (at least seven bunches of ions can be seen). This is in spite of the considerably higher pressure of 0.05 mbar (compared to 0.01 mbar used with the gathering potential) Argon gas employed here. Attempts were also made to optimise the efficiency of the gated release of ions with phase of the ion transport potential and also the ion injection energy. These attempts did not provide improvement compared to the data shown in FIG. 14.

Some ions 350*b* of m/z 100 can be seen to have been reflected back into the input quadrupole device, and hence would not have been transmitted at all.

This latter simulations show the improvement provided by the current invention compared to a representative prior art method.

The present disclosure, and embodiments of the present disclosure as disclosed herein, can be seen as helping to improve the control achievable over the formation and transportation of bunches in such a way that the mass range of each bunch can be increased, and the loss, overspill, and spread, of ions from selected potential wells can be reduced. As a result, the accuracy and duty cycle of analysis of ions can be improved.

When used in this specification and claims, the terms "comprises" and "comprising", "including" and variations thereof mean that the specified features, steps or integers are included. The terms are not to be interpreted to exclude the possibility of other features, steps or integers being present.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

All references referred to above are hereby incorporated by reference.

The invention claimed is:

1. An apparatus for transporting charged particles, the apparatus including:

a control unit; and a transport device having a plurality of electrodes arranged around a transport channel, wherein the transport channel includes a bunch forming region configured to receive charged particles received by the transport device;

wherein the control unit is configured to control voltages applied to the electrodes to generate a transport potential in the transport channel, the transport potential having a plurality of potential wells which are configured to move so as to transport charged particles along the transport channel in one or more bunches;

wherein the control unit is configured to control the voltages applied to the electrodes to:

temporarily generate a gathering potential in the bunch forming region so that charged particles received by the transport device are gathered in the bunch forming region, wherein the gathering potential includes a potential well for gathering charged particles in the bunch forming region, the potential well having a bottom located between an upstream potential barrier of the potential well and a downstream potential barrier of the potential well, wherein the upstream potential barrier is closer to an inlet of the transport device than the downstream potential barrier, and wherein a potential difference between the bottom of the potential well and the top of the upstream potential barrier is smaller than a potential difference between the bottom of the potential well and the top of the downstream potential barrier; and then, generate the transport potential in the bunch forming region so that a selected potential well is formed in the bunch forming region with the selected potential well receiving a bunch of charged particles formed from the charged particles gathered in the bunch forming region by the gathering potential.

2. An apparatus according to claim 1, wherein the bunch forming region of the transport channel contains a buffer gas.

3. An apparatus according to claim 1, wherein the gathering potential includes a radial confining potential, wherein the radial confining potential is configured to confine charged particles in a radial direction in the bunch forming region.

4. An apparatus according to claim 1, wherein the control unit is configured to control the voltages applied to the electrodes so that voltages for generating the transport potential in the bunch forming region are applied to the electrodes within 100 us of a time at which voltages for generating the gathering potential in the bunch forming region cease to be applied to the electrodes.

5. An apparatus according to claim 1, wherein the control unit is configured to control the voltages applied to the electrodes to generate the transport potential in a transport region of the transport channel both whilst the gathering potential is being temporarily generated in the bunch forming region and whilst the transport potential is being generated in the bunch forming region.

6. An apparatus according to claim 1, wherein the transport potential having a plurality of potential wells is a non-uniform high-frequency electric field, the pseudopotential of which has a plurality of continually moving potential wells.

7. An apparatus according to claim 1 wherein the control unit is configured to control the voltages applied to the electrodes to repeatedly:

temporarily generate a gathering potential in the bunch forming region so that charged particles received by the transport device are gathered in the bunch forming region; and then generate the transport potential in the bunch forming region so that a respective selected potential well is formed in the bunch forming region with the selected potential well receiving a bunch of charged particles formed from the charged particles gathered in the bunch forming region.

8. An apparatus according to claim 1, wherein the electrodes include a pair of solid rod electrodes extending along at least a part of the transport channel and/or a pair of segmented rod electrodes extending along at least a part of the transport channel.

9. An apparatus according to claim 1, wherein the electrodes of the transport device include a plurality of extraction electrodes, wherein the control unit is configured to control the extraction electrodes to generate an extraction potential configured to extract a bunch of charged particles contained by a target potential well in an extraction region of the transport channel out of the transport device through the outlet of the transport device.

10. An apparatus according to claim 9 wherein the extraction potential is configured to extract a bunch of charged particles contained by a target potential well in an extraction region of the transport channel out of the transport device through the outlet of the transport device in a direction that is orthogonal to a longitudinal axis that extends along the transport channel.

11. An apparatus according to claim 9 wherein the control unit is configured to control the voltages applied to the extraction electrodes to repeatedly:

generate the transport potential in the extraction region; and then temporarily generate an extraction potential configured to extract a bunch of charged particles contained by a target potential well in the extraction region of the transport channel out of the transport device through the outlet of the transport device.

12. An apparatus according to claim 11 wherein the control unit is configured to control the voltages applied to the extraction electrodes so that the extraction potential is temporarily generated in the extraction region when a target potential well has travelled to a predetermined location in the extraction region.

13. An apparatus according to claim 11 wherein the apparatus includes an extraction power supply for producing voltages to be applied to the extraction electrodes to generate the extraction potential in the extraction region, wherein the extraction power supply is separate from a transport power supply for producing voltages to be applied to the extraction electrodes to generate the transport potential in the extraction region.

14. An apparatus according to claim 9 wherein:

the electrodes include a pair of solid rod electrodes extending along at least a part of the transport channel; and the pair of solid rod electrodes is divided into at least two parts wherein one of said parts is arranged around the extraction region and serves as a pair of extraction electrodes.

15. An apparatus according to claim 9 wherein:

the electrodes include a pair of segmented rod electrodes extending along at least a part of the transport channel; and the pair of segmented rod electrodes include segmented electrodes arranged around the extraction region which serve as extraction electrodes.

16. An apparatus according to claim 1, further including:

a source of charged particles configured to produce charged particles, wherein the transport device is configured to receive charged particles produced by the source of charged particles; and an analysis device configured to analyse a bunch of charged particles that has been transported along the transport channel of the transport device by the transport potential.

17. An apparatus according to claim 16, wherein the source of charged particles is configured to produce a stream of charged particles to be received by the transport device.

18. A method of operating an apparatus that includes a transport device having a plurality of electrodes arranged around a transport channel, wherein the transport channel includes a bunch forming region configured to receive charged particles received by the transport device, the method including:

controlling voltages applied to the electrodes to generate a transport potential in the transport channel, the transport potential having a plurality of potential wells which are configured move so as to transport charged particles along the transport channel in one or more bunches;

controlling the voltages applied to the electrodes to:

temporarily generate a gathering potential in the bunch forming region so that charged particles received by the transport device are gathered in the bunch forming region wherein the gathering potential includes a potential well for gathering charged particles in the bunch forming region, the potential well having a bottom located between an upstream potential barrier of the potential well and a downstream potential barrier of the potential well, wherein the upstream potential barrier is closer to an inlet of the transport device than the downstream potential barrier, and wherein a potential difference between the bottom of the potential well and the top of the upstream potential barrier is smaller than a potential difference between the bottom of the potential well and the top of the downstream potential barrier; and then generate the transport potential in the bunch forming region so that a selected potential well is formed in the bunch forming region with the selected potential well receiving a bunch of charged particles formed from the charged particles gathered in the bunch forming region by the gathering potential.

* * * * *